US011312133B2

(12) United States Patent
Ozaki et al.

(10) Patent No.: US 11,312,133 B2
(45) Date of Patent: Apr. 26, 2022

(54) JETTING HEAD DRIVE UNIT, JETTING HEAD UNIT, LIQUID JETTING APPARATUS, JETTING HEAD DRIVE METHOD, AND PROGRAM

(71) Applicant: FUJIFILM Corporation, Tokyo (JP)

(72) Inventors: Yuichi Ozaki, Kanagawa (JP); Baku Nishikawa, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 17/030,279

(22) Filed: Sep. 23, 2020

(65) Prior Publication Data

US 2021/0001628 A1 Jan. 7, 2021

Related U.S. Application Data

(63) Continuation of application No. PCT/JP2019/008102, filed on Mar. 1, 2019.

(30) Foreign Application Priority Data

Apr. 26, 2018 (JP) ..... JP2018-085583

(51) Int. Cl.
*B41J 2/045* (2006.01)

(52) U.S. Cl.
CPC ..... *B41J 2/04588* (2013.01); *B41J 2/04541* (2013.01); *B41J 2/04581* (2013.01)

(58) Field of Classification Search
CPC . B41J 2/04588; B41J 2/04595; B41J 2/04598
See application file for complete search history.

(56) References Cited

U.S. PATENT DOCUMENTS

| | | | |
|---|---|---|---|
| 2008/0218554 | A1 | 9/2008 | Inoue |
| 2011/0084996 | A1 | 4/2011 | Hirato et al. |
| 2013/0083107 | A1 | 4/2013 | Nishikawa et al. |
| 2015/0116400 | A1 | 4/2015 | Sasaki |
| 2015/0191017 | A1 | 7/2015 | Matsumoto et al. |

(Continued)

FOREIGN PATENT DOCUMENTS

| | | |
|---|---|---|
| EP | 2308683 | 4/2011 |
| EP | 2639071 | 9/2013 |

(Continued)

OTHER PUBLICATIONS

"Search Report of Europe Counterpart Application", dated May 19, 2021, pp. 1-10.

(Continued)

*Primary Examiner* — Lam S Nguyen
(74) *Attorney, Agent, or Firm* — JCIPRNET

(57) ABSTRACT

A drive waveform acquisition unit that acquires a drive waveform; a drive voltage generation unit that generates a drive voltage; and a drive voltage supply unit that supplies the drive voltage are included. The drive waveform acquisition unit acquires an overflow waveform used to generate an overflow drive voltage. The drive voltage generation unit generates the overflow drive voltage including one or more overflow pulses corresponding to a period of 0.2 seconds or more and 90 seconds or less. The overflow pulses have a pulse width of 1.2 times or more and 1.8 times or less and an amplitude of 0.3 times or more and 0.8 times or less, and at least one of a rising period or a falling period of 0.3 times or less with respect to a jetting pulse.

20 Claims, 17 Drawing Sheets

(56) References Cited

U.S. PATENT DOCUMENTS

| | | | |
|---|---|---|---|
| 2015/0231907 | A1 | 8/2015 | Otokita et al. |
| 2017/0087850 | A1 | 3/2017 | Kerpe et al. |

FOREIGN PATENT DOCUMENTS

| | | |
|---|---|---|
| JP | H07101081 | 4/1995 |
| JP | 2006218748 | 8/2006 |
| JP | 2008093994 | 4/2008 |
| JP | 2008221534 | 9/2008 |
| JP | 2009034859 | 2/2009 |
| JP | 2012071568 | 4/2012 |
| JP | 2013193264 | 9/2013 |
| JP | 2015085557 | 5/2015 |
| JP | 2015131419 | 7/2015 |

OTHER PUBLICATIONS

"International Search Report (Form PCT/ISA/210) of PCT/JP2019/008102", dated Apr. 23, 2019, with English translation thereof, pp. 1-4.

"Written Opinion of the International Searching Authority (Form PCT/ISA/237) of PCT/JP2019/008102", dated Apr. 23, 2019, with English translation thereof, pp. 1-7.

JETTING HEAD DRIVE UNIT, JETTING HEAD UNIT, LIQUID JETTING APPARATUS, JETTING HEAD DRIVE METHOD, AND PROGRAM

CROSS-REFERENCE TO RELATED APPLICATIONS

This application is a Continuation of PCT International Application No. PCT/JP2019/008102 filed on Mar. 1, 2019, which claims priority under 35 U.S.C § 119(a) to Japanese Patent Application No. 2018-085583 filed on Apr. 26, 2018. Each of the above application(s) is hereby expressly incorporated by reference, in its entirety, into the present application.

BACKGROUND OF THE INVENTION

1. Field of the Invention

The present invention relates to a jetting head drive unit, a jetting head unit, a liquid jetting apparatus, a jetting head drive method, and a non-transitory computer readable recording medium storing a program, and more particularly to removal of mist on a nozzle surface.

2. Description of the Related Art

In a case where continuous printing is executed using ink jet printers, ink mist may adhere to the periphery of a nozzle opening, and the jetting state may be deteriorated. Thus, it is necessary to remove the ink mist that has adhered to the periphery of the nozzle opening. As a general method for removing the ink mist, a method of wiping a nozzle surface using a wiping member such as a blade and a web is known.

Wiping the nozzle surface using the wiping member has the following problems.

<1>

By stopping the transportation of a medium or idling a medium transport unit supporting the medium, downtime and wasteful consumption of the medium occur.

<2>

The shape of a meniscus may be collapsed, and the jetting state of a normal nozzle may be temporarily deteriorated. The downtime occurs in a case where a nozzle whose jetting state has deteriorated is detected using a nozzle check pattern and the detected nozzle is corrected using correction processing such as mask processing.

<3>

In ink jet heads that jet black ink, friction occurs between carbon pigment contained in the ink and a liquid repellent film on the nozzle surface, and deterioration of the liquid repellent film occurs. Accordingly, the life of the ink jet heads is shortened.

<4>

Consumables such as cleaning liquid and web are generated.

A dummy jet is known as a similar technique for maintaining the jetting accuracy during the continuous printing. The dummy jet is discharging thickened ink in the nozzle, and it is difficult to remove the ink mist adhering to the periphery of the nozzle opening. As a solution to the problems described in the above <1> to <4>, there is known a technique of causing ink to overflow from the nozzle to the nozzle surface and recovering the ink caused to overflow to the nozzle surface to the nozzle.

JP1995-101081 (JP-H07-101081A) describes an ink jet recording device in a thermal recording head that pushes out the ink in the nozzle from a jetting port to cause the ink to overflow to a jetting port surface to remove ink adhering to the jetting port surface, paper dust, and the like.

In the invention described in JP1995-101081 (JP-H07-101081A), in a case where the ink is caused to overflow to the jetting port surface, the ink is pressurized by using a gear pump provided in the middle of an ink supply passage. Additionally, in a case where the ink caused to overflow to the jetting port surface is recovered, the gear pump is stopped to lower the height of an ink surface in an ink tank with respect to the height of the jetting port so that negative pressure is applied to the ink caused to overflow to the jetting port surface.

JP2015-085557A describes an image forming apparatus including a piezoelectric ink jet head. The image forming apparatus described in JP2015-085557A vibrates a meniscus by using a non-jetting pulse to draw ink mist adhering to the vicinity of a nozzle into the nozzle in a case where the meniscus protrudes out of the nozzle, and removes the ink mist from the periphery of the nozzle.

JP2009-034859A describes a serial image forming apparatus including a piezoelectric recording head. The image forming apparatus described in JP2009-034859A vibrates the meniscus by using an overflow drive signal to cause the ink to overflow to the periphery of the nozzle. In a case where the ink overflowing to the periphery of the nozzle returns to the inside of the nozzle, a deposit around the nozzle is incorporated into the ink and the deposit is recovered to the inside of the nozzle.

SUMMARY OF THE INVENTION

However, the processing described in JP1995-101081 (JP-H07-101081A), JP2015-085557A, and JP2009-034859A for causing the ink to overflow from the nozzle to the nozzle surface have the following problems.

<5>

In a case where the overflow range is too narrow, the effect of removing mist or the like cannot be sufficiently obtained.

<6>

In a case where the overflow range is too wide and in a case where the overflowing ink is drawn into the nozzle, the ink is torn and the ink remains on the nozzle surface, and the ink remaining on the nozzle surface is dried and solidified. In a case where the solidified ink is removed from the nozzle surface by using a blade, a web, or the like after the continuous printing, there is a concern that the solidified ink may be pushed into the nozzle, which may produce a side effect of causing a jetting failure.

<7>

In order to reduce the downtime, it is necessary for all the nozzles to uniformly cause the ink to overflow in an optimal overflow range in a short period of time.

That is, in order to remove the ink mist and reduce the downtime, it is necessary to control the ink overflow range and the ink overflow period.

Here, although the problems have been described by way of the examples of the ink jet printers, the problems may be similarly present also in liquid jetting apparatuses including an ink jet type liquid jetting head other than graphic applications.

The inventions described in JP1995-101081 (JP-H07-101081A), JP2015-085557A, and JP2009-034859A have no description regarding the above problems <5> to <7>, and Patent Documents 1 to 3 do not describe effective solutions for the above problems <5> to <7>.

The present invention has been made in view of such circumstances, and an object thereof is to provide a jetting head drive unit, a jetting head unit, a liquid jetting apparatus, a jetting head drive method, and a non-transitory computer readable recording medium storing a program capable of realizing a suitable overflow range and a suitable overflow period.

In order to achieve the above object, the following invention aspects are provided.

A jetting head drive unit according to a first aspect is a drive unit for a jetting head including a plurality of nozzles and a plurality of piezoelectric elements corresponding to the plurality of nozzles. The jetting head drive unit comprises a drive waveform acquisition unit that acquires a drive waveform; a drive voltage generation unit that generates a drive voltage to be supplied to the piezoelectric elements using the drive waveform; and a drive voltage supply unit that supplies the drive voltage to the piezoelectric elements. The drive waveform acquisition unit acquires an overflow waveform used to generate an overflow drive voltage when a liquid is caused to overflow from the nozzle to a nozzle surface without jetting the liquid from the nozzle. The drive voltage generation unit uses the overflow waveform to generate the overflow drive voltage including one or more overflow pulses corresponding to a period of 0.2 seconds or more and 90 seconds or less. The overflow pulses have a pulse width of 1.2 times or more and 1.8 times or less and an amplitude of 0.3 times or more and 0.8 times or less, and at least one of a rising period or a falling period of 0.3 times or less, with respect to a jetting pulse included in a jetting drive voltage when the liquid is jetted from the nozzles.

According to the first aspect, the pulse width and the amplitude of the overflow pulses are specified. Additionally, at least one of the rising period or the falling period of the overflow pulses is specified. Moreover, the supply period of the overflow drive voltage is specified by using the number of overflow pulses. Accordingly, it is possible to realize a suitable overflow range and a suitable overflow period in the overflow processing for causing ink to overflow from the nozzle to the liquid jetting surface.

The drive waveform represents a concept including an overflow waveform and a jetting waveform. The drive waveform may include a waveform group configured by a plurality of unit waveforms. The drive waveform may be configured by a plurality of unit waveforms.

The jetting drive voltage may be generated by selecting one or more jetting pulses from a jetting pulse group including a plurality of jetting pulses.

In a case where the overflow pulses have a trapezoidal waveform of positive logic, the pulse width can be a period of a maximum potential. The amplitude may be a potential difference between the maximum potential and a reference voltage. The rising period may be a period from the reference potential to the maximum potential. The falling period may be a period from the maximum potential to the reference potential.

In a case where the overflow pulses have a trapezoidal waveform of negative logic, the pulse width can be a period of a minimum potential. The amplitude may be a potential difference between the reference potential and the minimum potential. The rising period may be a period from the reference potential to the minimum potential. The falling period may be a period from the minimum potential to the reference potential.

In a second aspect based on the jetting head drive unit according to the first aspect, the drive voltage supply unit may supply the drive voltage to the jetting head after a period of 0.5 seconds or more and 120 seconds or less has elapsed from a termination timing of the overflow drive voltage.

According to the second aspect, it is possible to suppress the occurrence of abnormality of the nozzle in the printing after the overflow processing.

In a third aspect based on the jetting head drive unit according to the first aspect or the second aspect, the pulse width of the overflow pulse may be three-fourths of a natural period of a surface of the liquid.

In the third aspect, the pulse width of the jetting pulse may be one half of the natural period of the surface of the liquid.

In a fourth aspect based on the jetting head drive unit according to any one of the first to third aspects, the jetting head may be divided into a plurality of regions including one or more nozzles, and the drive voltage supply unit may supply the overflow drive voltage to the jetting head for each of the regions.

According to the fourth aspect, in the jetting head divided into the plurality of regions, the overflow processing can be performed for each region.

In a fifth aspect based on the jetting head drive unit according to any one of the first to fourth aspects, the overflow waveform may include a plurality of the overflow pulses.

According to the fifth aspect, the plurality of overflow pulses are caused to act on the liquid. Accordingly, even in a case where the liquid does not overflow from the nozzle to the nozzle surface with one overflow pulse, it is possible to reliably overflow the liquid from the nozzle to the nozzle surface.

An aspect in which the period intervals of the plurality of pulses are equal is preferable.

A jetting head unit according to a sixth aspect comprises a jetting head including a plurality of nozzles and a plurality of piezoelectric elements corresponding to the plurality of nozzles; and a drive unit that drives the jetting head. The drive unit includes a drive waveform acquisition unit that acquires a drive waveform; a drive voltage generation unit that generates a drive voltage to be supplied to the piezoelectric elements using the drive waveform; and a drive voltage supply unit that supplies the drive voltage to the piezoelectric elements. The drive waveform acquisition unit acquires an overflow waveform used to generate an overflow drive voltage when a liquid is caused to overflow from the nozzle to a nozzle surface without jetting the liquid from the nozzle. The drive voltage generation unit uses the overflow waveform to generate the overflow drive voltage including one or more overflow pulses corresponding to a period of 0.2 seconds or more and 90 seconds or less. The overflow pulses have a pulse width of 1.2 times or more and 1.8 times or less and an amplitude of 0.3 times or more and 0.8 times or less, and at least one of a rising period or a falling period of 0.3 times or less, with respect to a jetting pulse included in the jetting drive voltage when the liquid is jetted from the nozzles.

According to the sixth aspect, the same effects as those of the first aspect can be obtained.

In the sixth aspect, the same items as the items specified in the second to fifth aspects can be appropriately combined together. In that case, the constituent elements that carry the processing and functions specified in the jetting head drive unit can be grasped as the constituent elements of the jetting head unit that carry the corresponding processing and functions.

A liquid jetting apparatus according to a seventh aspect comprises a liquid jetting head including a plurality of nozzles and a plurality of piezoelectric elements corresponding to the plurality of nozzles; and a drive unit that drives the jetting head. The drive unit includes a drive waveform acquisition unit that acquires a drive waveform; a drive voltage generation unit that generates a drive voltage to be supplied to the piezoelectric elements using the drive waveform; and a drive voltage supply unit that supplies the drive voltage to the piezoelectric elements. The drive waveform acquisition unit acquires an overflow waveform used to generate an overflow drive voltage when a liquid is caused to overflow from the nozzle to a nozzle surface without jetting the liquid from the nozzle. The drive voltage generation unit uses the overflow waveform to generate the overflow drive voltage including one or more overflow pulses corresponding to a period of 0.2 seconds or more and 90 seconds or less. The overflow pulses have a pulse width of 1.2 times or more and 1.8 times or less, an amplitude of 0.3 times or more and 0.8 times or less, and at least one of a rising period or a falling period of 0.3 times or less, with respect to a jetting pulse included in a jetting drive voltage when the liquid is jetted from the nozzles.

According to the seventh aspect, the same effects as those of the first aspect can be obtained.

In the seventh aspect, the same items as the items specified in the second to fifth aspects can be appropriately combined together. In that case, the constituent elements that carry the processing and functions specified in the jetting head drive unit can be grasped as the constituent elements of the liquid jetting apparatus that carry the corresponding processing and functions.

In an eighth aspect based on the liquid jetting apparatus according to the seventh aspect, when the liquid is jetted from the jetting head to continuously generate a plurality of resultant products, the drive voltage supply unit may supply the overflow drive voltage to the jetting head between generation of the resultant product and generation of the next resultant product that are performed using a jetting drive voltage based on jetting data representing the resultant products.

According to the eighth aspect, the liquid is caused to overflow from the nozzle to the nozzle surface during the generation of the resultant product. Accordingly, any interruption of the generation of the resultant product can be avoided, and the downtime can be reduced.

A ninth aspect is the liquid jetting apparatus according to the seventh aspect or the eighth aspect may further comprise a reading unit that reads a jetting abnormality detection pattern; and an abnormal nozzle detection unit that detects an abnormal nozzle from a reading result of the jetting abnormality detection pattern obtained using the reading unit. The drive voltage supply unit may supply the overflow drive voltage to the jetting head, and then supply a detected drive voltage corresponding to the jetting abnormality detection pattern to the jetting head to form the jetting abnormality detection pattern before the next resultant product is generated. The abnormal nozzle detection unit may detect an abnormal nozzle in the jetting head after the overflow drive voltage is supplied.

According to the ninth aspect, it is possible to detect an abnormal nozzle due to the overflow processing. Accordingly, it is possible to perform handling such as non-jetting processing on an abnormal nozzle that occurs when the liquid is caused to overflow from the nozzle to the nozzle surface.

A tenth aspect based on the liquid jetting apparatus according to the ninth aspect in which a plurality of the jetting heads that jets different types of liquid are provided, and the drive voltage supply unit may supply the overflow drive voltage and then supply the detected drive voltage to the jetting heads to which the overflow drive voltage is supplied, to form the jetting abnormality detection pattern.

According to the tenth aspect, even in a case where a region for forming an abnormal jetting pattern cannot be secured for the plurality of jetting heads, an abnormal nozzle can be detected after the overflow processing for the jetting head that has performed the overflow processing.

In a case where the jetting abnormality detection pattern is formed for each jetting head, the abnormality detection pattern can be formed in a blank region of the medium. Accordingly, the medium used for forming the jetting abnormality detection pattern can be reduced.

A jetting head drive method according to an eleventh aspect is a method for driving a jetting head including a plurality of nozzles and a plurality of piezoelectric elements corresponding to the plurality of nozzles. The jetting head drive method comprises a drive waveform acquisition step of acquiring a drive waveform; a drive voltage generation step of generating a drive voltage to be supplied to the piezoelectric elements using the drive waveform; and a drive voltage supply step of supplying the drive voltage to the piezoelectric elements. The drive waveform acquisition step acquires an overflow waveform used to generate an overflow drive voltage when a liquid is caused to overflow from the nozzle to a nozzle surface without jetting the liquid from the nozzle. The drive voltage generation step uses the overflow waveform to generate the overflow drive voltage including one or more overflow pulses corresponding to a period of 0.2 seconds or more and 90 seconds or less. The overflow pulses have a pulse width of 1.2 times or more and 1.8 times or less and an amplitude of 0.3 times or more and 0.8 times or less, and at least one of a rising period or a falling period of 0.3 times or less, with respect to a jetting pulse included in the jetting drive voltage when the liquid is jetted from the nozzle.

According to the eleventh aspect, the same effects as those of the first aspect can be obtained.

In the eleventh aspect, the same items as the items specified in the second to fifth aspects and the eighth to tenth aspects can be appropriately combined together. In that case, the constituent elements that carry the processing and functions specified in the jetting head drive unit can be grasped as the constituent elements of the jetting head drive method that carry the corresponding processing and functions.

A non-transitory computer readable recording medium storing a program according to a twelfth aspect is a non-transitory computer readable recording medium storing a program to be applied to driving of a jetting head including a plurality of nozzles and a plurality of piezoelectric elements corresponding to the plurality of nozzles, the program causing a computer to realize a drive waveform acquisition function of acquiring a drive waveform; a drive voltage generation function of generating a drive voltage to be supplied to the piezoelectric elements using the drive waveform; and a drive voltage supply function of supplying the drive voltage to the piezoelectric elements. The drive waveform acquisition function acquires an overflow waveform used to generate an overflow drive voltage when a liquid is caused to overflow from the nozzle to a nozzle surface without jetting the liquid from the nozzle. The drive voltage generation function uses the overflow waveform to generate the overflow drive voltage including one or more overflow pulses corresponding to a period of 0.2 seconds or more and 90 seconds or less. The overflow pulses have a pulse width of 1.2 times or more and 1.8 times or less and an amplitude of 0.3 times or more and 0.8 times or less, and at least one of a rising period or a falling period of 0.3 times or less, with respect to a jetting pulse included in the jetting drive voltage when the liquid is jetted from the nozzles.

According to the twelfth aspect, the same effects as those of the first aspect can be obtained.

In the twelfth aspect, the same items as the items specified in the second to fifth aspects and the eighth to tenth aspects can be appropriately combined together. In that case, the constituent elements that carry the processing and functions specified in the jetting head drive unit can be grasped as the constituent elements of the non-transitory computer readable recording medium storing the program that carry the corresponding processing and functions.

A jetting head drive unit according to another aspect is a drive unit for a jetting head including a plurality of nozzles and a plurality of piezoelectric elements corresponding to the plurality of nozzles. The jetting head drive unit comprises one or more processors. The processors function as a drive waveform acquisition unit that acquires a drive waveform; a drive voltage generation unit that generates a drive voltage to be supplied to the piezoelectric elements using the drive waveform; and a drive voltage supply unit that supplies the drive voltage to the piezoelectric elements. The drive waveform acquisition unit acquires an overflow waveform including one or more overflow pulses used to generate an overflow drive voltage when a liquid is caused to overflow from the nozzle to a nozzle surface without jetting the liquid from the nozzle. The overflow pulses have a pulse width of 1.2 times or more and 1.8 times or less and an amplitude of 0.3 times or more and 0.8 times or less, and at least one of a rising period or a falling period of 0.3 times or less, with respect to a jetting pulse of a jetting waveform used for the jetting drive voltage when the liquid is jetted from the nozzles. The overflow waveform includes one or more overflow pulses corresponding to a period of 0.2 seconds or more and 90 seconds or less.

According to the present invention, at least one of the pulse width, the amplitude, the rising period, or the falling period of the overflow pulses is specified, and the supply period of the overflow drive voltage is specified using the number of overflow pulses. Accordingly, it is possible to realize a suitable overflow range and a suitable overflow period in the overflow processing for causing ink to overflow from the nozzle to the liquid jetting surface.

DESCRIPTION OF THE PREFERRED EMBODIMENTS

Hereinafter, preferred embodiments of the present invention will be described in detail with reference to the accompanying drawings. In the present specification, the same constituent elements will be denoted by the same reference signs, and overlapping descriptions thereof will be appropriately omitted.

[Overview of Overflow Processing]

Figure 1:
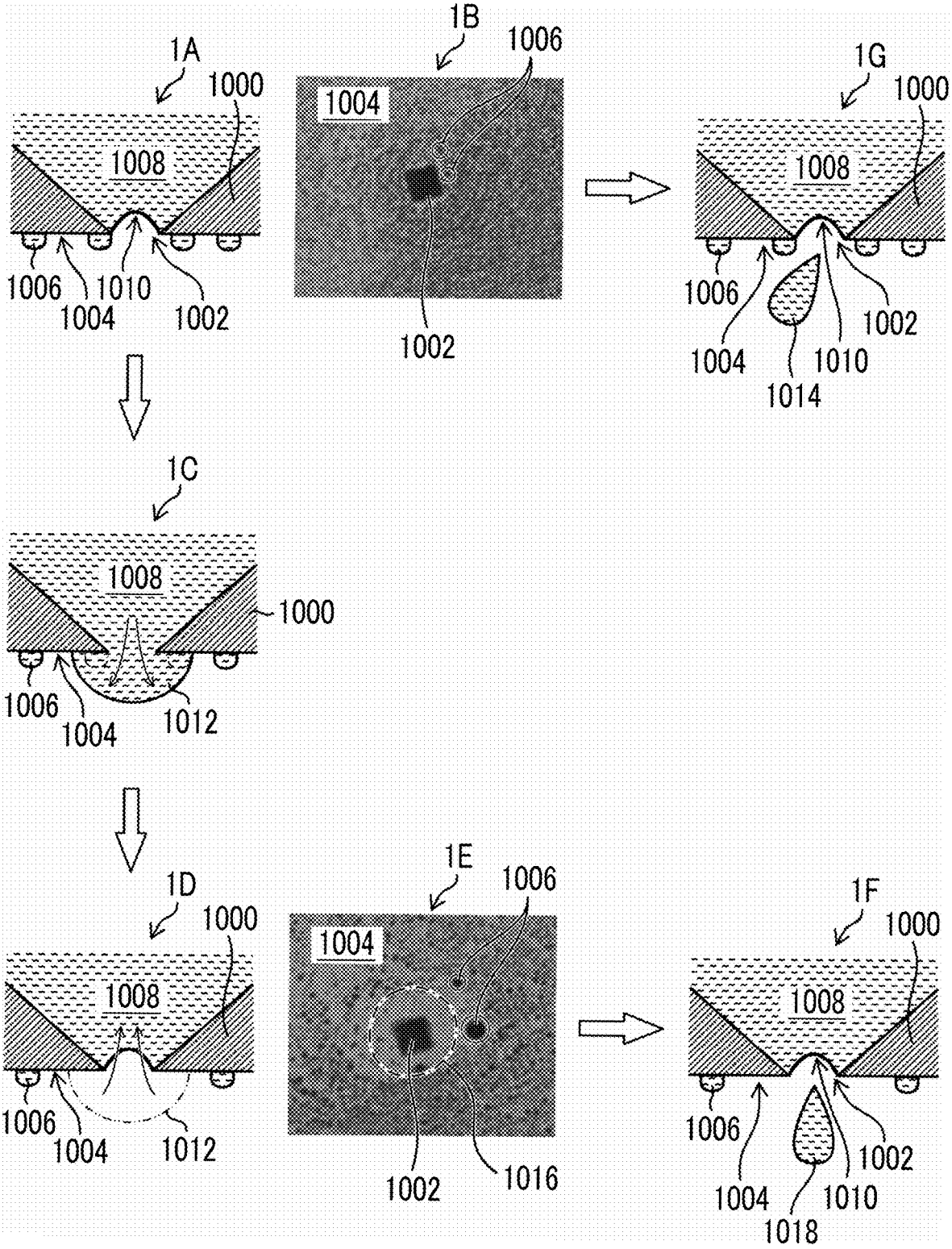
FIG. 1 is a schematic view of overflow processing.

FIG. 1 is a schematic view of overflow processing. Reference signs 1A, 1C, 1D, 1F, and 1G in FIG. 1 indicate cross-sectional views of a nozzle 1002 provided in an ink jet head 1000. Reference signs 1B and 1E indicate enlarged photographs of the nozzle surface 1004. Reference sign 1008 indicates the ink inside the nozzle 1002. Reference sign 1010 represents an ink liquid surface. The ink liquid surface 1010 may be referred to as a meniscus or a meniscus surface.

Reference sign 1A in FIG. 1 indicates s a state where ink mist 1006 adheres to the nozzle surface 1004. Reference sign 1B is an enlarged photograph of the vicinity of the nozzle surface 1004 to which the ink mist 1006 adheres. The ink mist 1006 adheres to the nozzle surface 1004 during execution of continuous printing or immediately after the execution of the continuous printing. As indicated by reference sign 1G in a case where the ink mist 1006 adheres to the vicinity of an opening of the nozzle 1002, jetting abnormality such as jetting bending may occur. The jetting bending of a liquid droplet 1014 occurs.

Reference sign 1C indicates a state where ink 1012 is caused to overflow to the nozzle surface 1004. Reference sign 1D indicates a state where the ink 1012 caused to overflow to the nozzle surface 1004 is recovered to the nozzle 1002. In the nozzle overflow processing denoted by reference sign 1C, ink 1008 in the nozzle 1002 is caused to overflow to the nozzle surface 1004, and the ink 1012 caused to overflow to the nozzle surface 1004 spreads to a specified range. An arrow line of reference sign 1C indicates the movement direction of the ink 1008.

After the state where the ink 1012 is caused to overflow to the nozzle surface 1004 is maintained for a specified overflow period, the ink 1012 caused to overflow to the nozzle surface 1004 is recovered to the inside of the nozzle 1002, as indicated by reference sign 1D. An arrow line of reference sign 1D indicates a movement direction of the ink 1012. The overflow processing shown in the present embodiment can remove at least a part of the ink mist 1006 that adheres to the nozzle surface 1004. A two-dot dashed line of reference sign 1D indicates the ink 1012 caused to overflow to the nozzle surface 1004 indicated by reference sign 1C.

A dashed-dotted line of reference sign 1E indicates a region 1016 on the nozzle surface 1004 to which the ink 1012 caused to overflow from the nozzle 1002 adheres. The ink mist 1006 adheres to the vicinity of the opening of the nozzle 1002 on the nozzle surface 1004 indicated by reference sign 1B, but the ink mist 1006 is removed on the nozzle surface 1004 indicated by reference sign 1E.

Accordingly, it is possible to prevent the jetting abnormality caused by the ink mist 1006 that has adhered to the nozzle surface 1004. Additionally, the jetting state can be restored in a case where the jetting abnormality occurs. Reference sign 1F indicates a state where the liquid droplet 1018 is normally jetted.

Although the nozzle 1002 having a quadrangular opening shape is illustrated in FIG. 1, the overflow processing described with reference to FIG. 1 is performed by using vibration based on the natural period of the ink liquid surface 1010 and does not depend on the opening shape of the nozzle 1002. The overflow processing can also be applied to a nozzle having a circular opening shape.

[Overflow Waveform Applied to Overflow Processing]

[Explanation of Overflow Processing]

Figure 2:
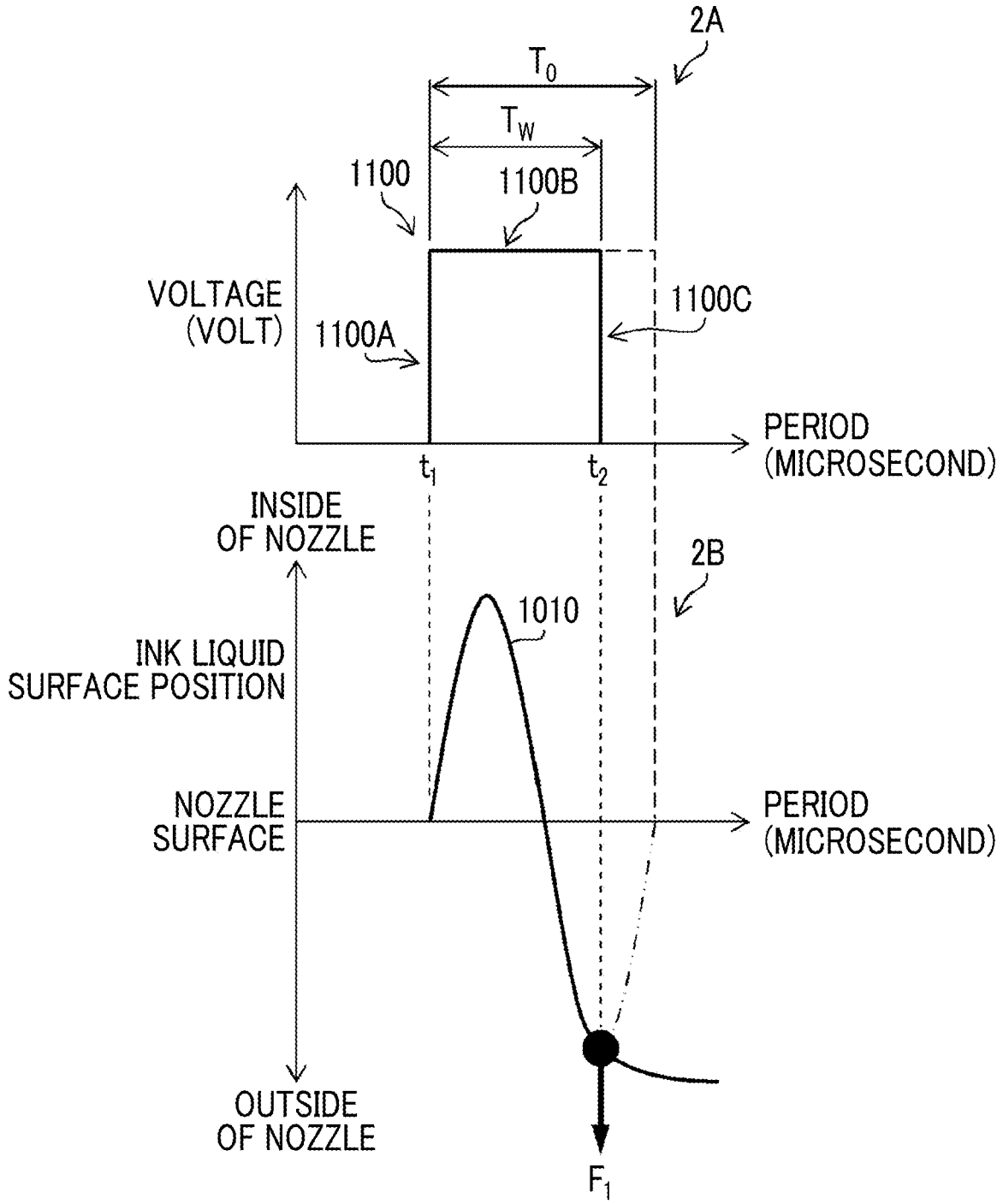
FIG. 2 is an explanatory view illustrating a relationship between an overflow drive voltage and the behavior of an ink liquid surface.

FIG. 2 is an explanatory view illustrating a relationship between an overflow drive voltage and the behavior of the ink liquid surface. Reference sign 2A indicates one overflow pulse 1100 included in the overflow drive voltage, using a graph form. The horizontal axis is the period. The unit of the period is microsecond. The vertical axis is the voltage. The unit of voltage is volts. A pulse width $T_W$ of the overflow pulse 1100 is set to three quarters of a natural period $T_0$ of the ink liquid surface 1010.

Reference sign 2B indicates the behavior of any one point on the ink liquid surface 1010, using a graph form. The horizontal axis represents a period. The unit of the period is microsecond. The vertical axis of reference sign 2B represents an ink liquid surface position. The ink liquid surface position represents the position of any one point on the ink liquid surface 1010. A region of the vertical axis above the horizontal axis indicates the inside of the nozzle 1002. A region of the vertical axis below the horizontal axis indicates the outside of the nozzle 1002.

At a timing $t_1$ at which a rising waveform element 1100A of the overflow pulse 1100 is supplied, a negative pressure (not illustrated) is applied to the ink liquid surface 1010. The ink liquid surface 1010 moves to the inside of the nozzle 1002 depending on the negative pressure. Additionally, vibration having the natural period $T_0$ is generated on the ink liquid surface 1010.

In the period of a fixed voltage waveform element 1100B of the overflow pulse 1100, the ink liquid surface 1010 vibrates according to the natural period $T_0$ and moves toward the outside of the nozzle 1002. A timing $t_2$ at which a falling waveform element 1100C of the overflow pulse 1100 is supplied corresponds to a state where the ink liquid surface 1010 most comes outward from the nozzle 1002.

At the timing $t_2$, in a case where a pressure $F_1$ toward the outside of the nozzle 1002 is applied to the ink liquid surface 1010, the ink 1008 overflows from the nozzle 1002 to the nozzle surface 1004.

[Explanation of Jetting]

Figure 3:
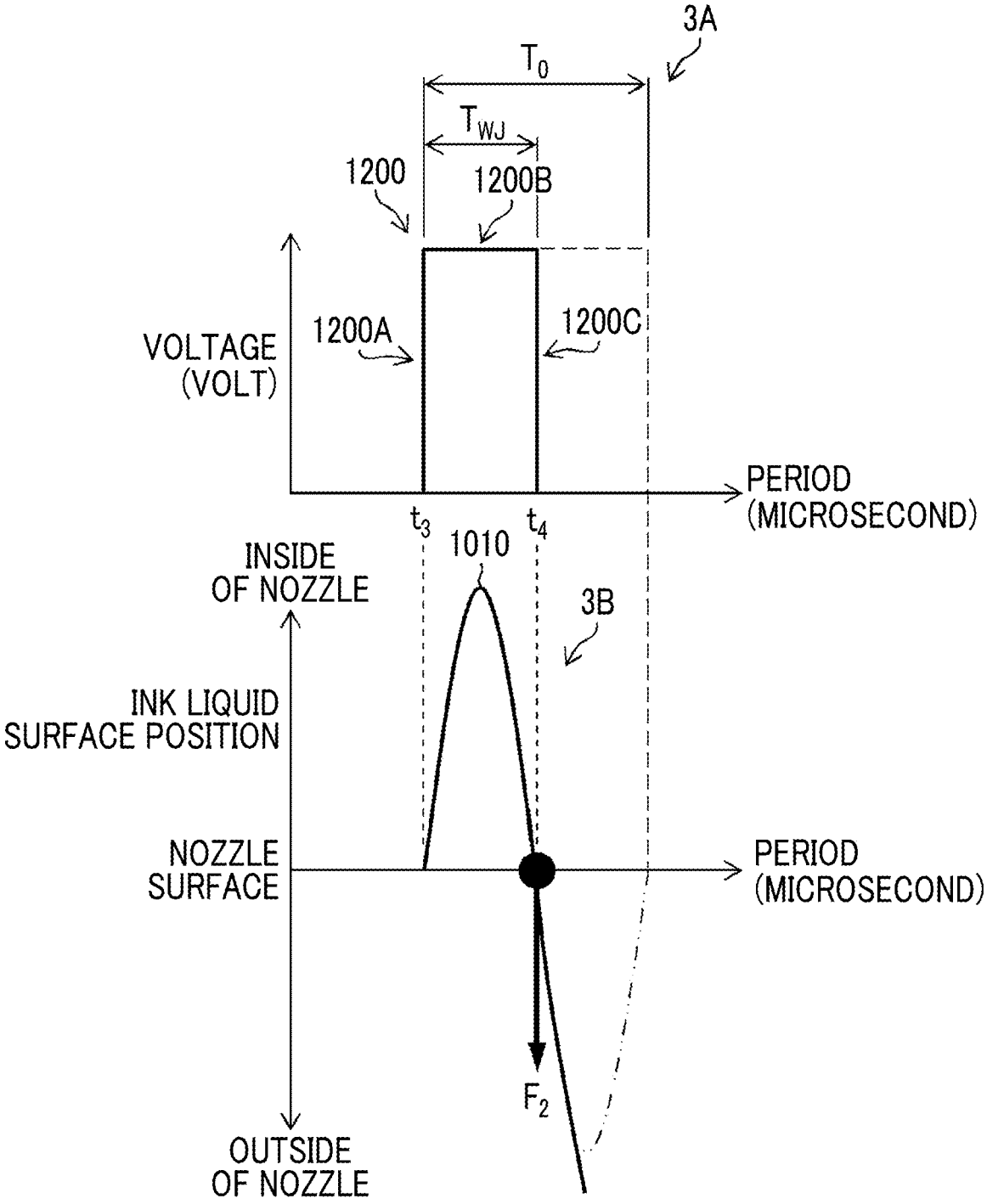
FIG. 3 is an explanatory view illustrating a relationship between a jetting drive voltage and the behavior of the ink liquid surface.

FIG. 3 is an explanatory view illustrating a relationship between a jetting drive voltage and the behavior of the ink liquid surface. Reference sign 3A indicates one jetting pulse 1200 included in the jetting drive voltage, using a graph form. The horizontal axis is the period. The unit of the period is microsecond. The vertical axis is the voltage. The unit of voltage is volts. A pulse width $T_{WJ}$ of the jetting pulse 1200 is set to one half of the natural period $T_0$ of the ink liquid surface 1010.

Reference sign 3B indicates the behavior of any one point on the ink liquid surface 1010, using a graph form. The horizontal axis represents a period. The unit of the period is microsecond. The vertical axis of reference sign 3B represents the ink liquid surface position. A region of the vertical axis above the horizontal axis indicates the inside of the nozzle 1002. A region of the vertical axis below the horizontal axis indicates the outside of the nozzle 1002.

At a timing $t_3$ at which a rising waveform element 1200A of the jetting pulse 1200 is supplied, a negative pressure (not illustrated) is applied to the ink liquid surface 1010. The ink liquid surface 1010 moves to the inside of the nozzle 1002 depending on the negative pressure. Additionally, vibration having the natural period $T_0$ is generated on the ink liquid surface 1010.

In the period of the fixed voltage waveform element 1200B of the jetting pulse 1200, the ink liquid surface 1010 vibrates according to the natural period $T_0$ and moves toward the outside of the nozzle 1002. A timing $t_4$ at which a falling waveform element 1200C of the jetting pulse 1200 is supplied corresponds to a state where the speed of the ink liquid surface 1010 is the fastest. At the timing $t_4$, in a case where a pressure $F_2$ directed to the outside of the nozzle 1002 is applied to the ink liquid surface 1010, the liquid droplet 1018 is jetted from the nozzle 1002.

FIG. 3 illustrates a case where one jetting pulse 1200 is used to jet one liquid droplet 1018, but a jetting pulse 1200 including a plurality of jetting pulses may be configured and one liquid droplet 1018 may be jetted using the plurality of jetting pulses. The one liquid droplet 1018 referred to herein may be formed by coalescing a plurality of minute liquid droplets during flight.

[Explanation of Overflow Drive Voltage]

Figure 4:
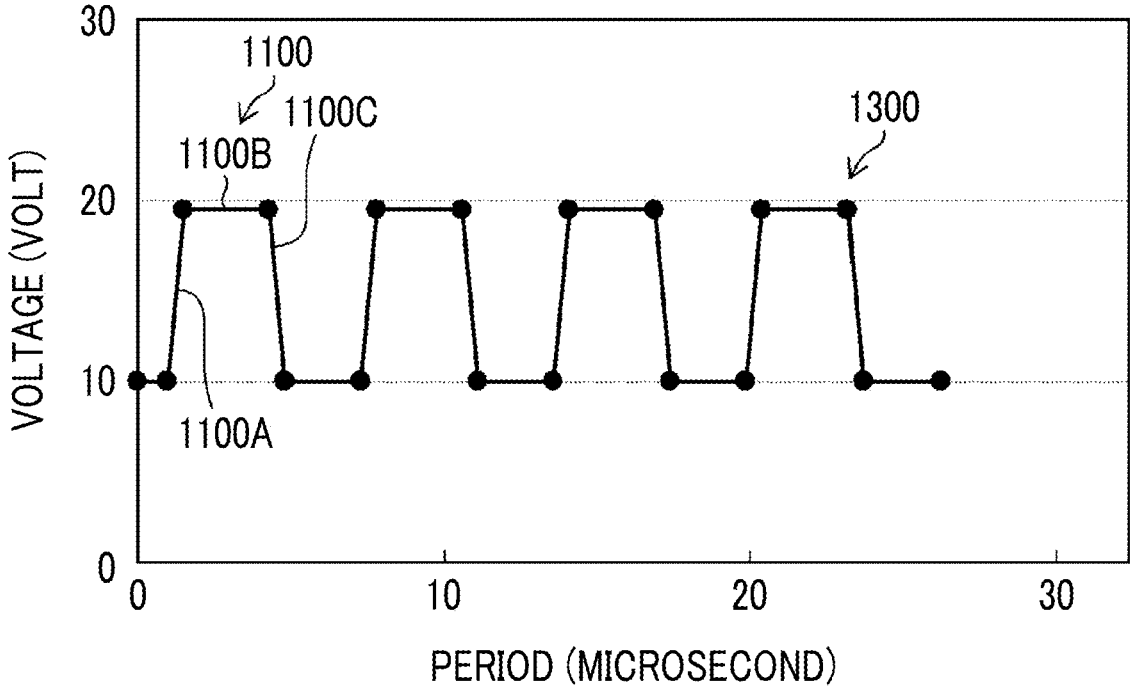
FIG. 4 is an explanatory view of the overflow drive voltage.

FIG. 4 is an explanatory view of the overflow drive voltage. FIG. 4 illustrates an overflow drive voltage 1300, using a graph form. The horizontal axis is the period. The unit of the period is microsecond. The vertical axis is the voltage. The unit of voltage is volts.

The overflow drive voltage 1300 illustrated in FIG. 4 includes a plurality of overflow pulses 1100, and is generated using an overflow drive waveform in which the period intervals of the overflow pulses 1100 are equal. In addition, the overflow drive voltage 1300 may have an aspect in which some or all of the period intervals of the overflow pulses 1100 are different.

Even in a case where the ink 1008 cannot be caused to overflow from the nozzle 1002 to the nozzle surface 1004 by one overflow pulse 1100, the second and subsequent overflow pulses 1100 act on the vibrating ink liquid surface 1010 to allow the ink 1008 to overflow from the nozzle 1002 to the nozzle surface 1004.

Although the plurality of overflow pulses 1100 having the same waveform are exemplified in FIG. 4, some or all of the overflow pulses 1100 may have different waveforms. That is, the overflow pulses 1100 that constitute the overflow drive voltage 1300 may have different periods, waveforms, and the like within a range that satisfies specified conditions.

Although the overflow drive voltage 1300 having a reference potential of 10 volt is illustrated in FIG. 4, any potential such as 0 volt can be applied as the reference potential. The same applies to a jetting drive voltage illustrated in FIG. 5 and a meniscus fluctuation drive voltage illustrated in FIG. 6.

Figure 5:
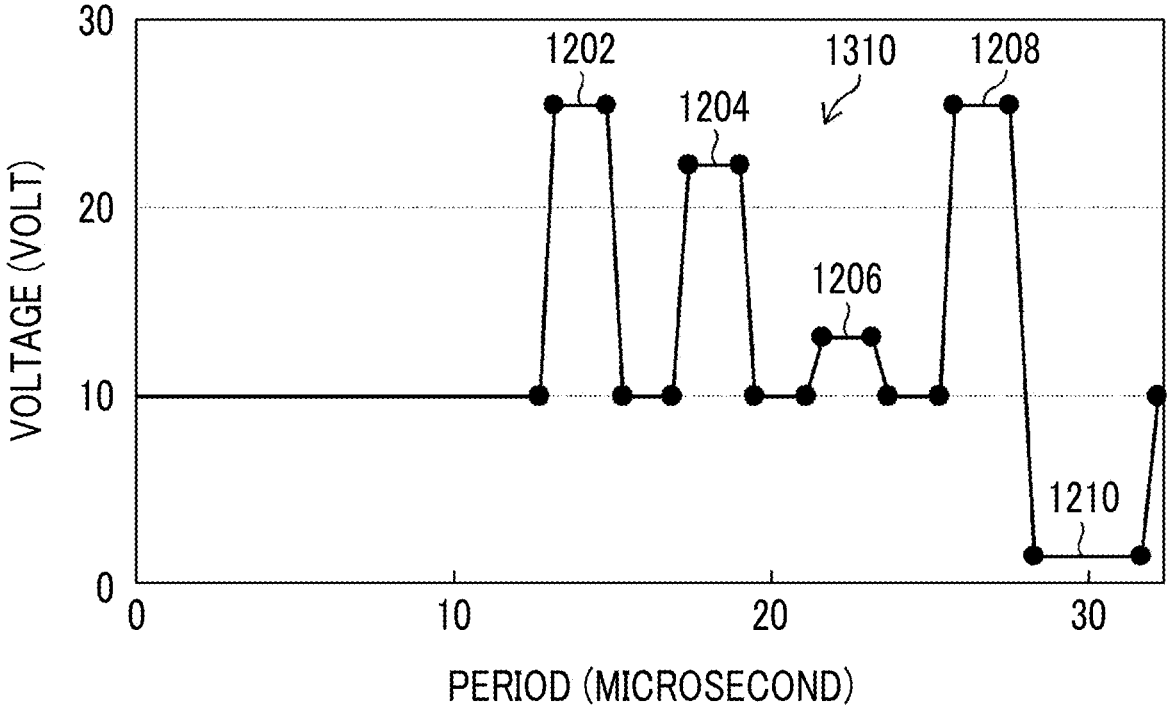
FIG. 5 is an explanatory view of the jetting drive voltage.

FIG. 5 is an explanatory view of the jetting drive voltage. FIG. 5 illustrates a jetting drive voltage 1310, using a graph form. The horizontal axis is the period. The unit of the period is microsecond. The vertical axis is the voltage. The unit of voltage is volts.

The jetting drive voltage 1310 illustrated in FIG. 5 realizes a specified jetting amount by using a plurality of jetting pulses. The jetting drive voltage 1310 includes a first jetting pulse 1202, a second jetting pulse 1204, a third jetting pulse 1206, a fourth jetting pulse 1208, and a fifth jetting pulse 1210.

The jetting drive voltage 1310 jets medium droplets when liquid droplets of three sizes are used. In a case where a maximum size of the three sizes is a large droplet and a minimum size is a small droplet, a medium droplet corresponds to a medium size. In addition, the jetting drive voltage 1310 may include a detected drive voltage when where a nozzle check pattern is formed.

The jetting drive voltage 1310 may be configured by selecting one or more jetting pulses depending on the droplet size from a jetting pulse group including a jetting pulse corresponding to the large droplet, a jetting pulse corresponding to the medium droplet, and a jetting pulse corresponding to the small droplet.

Figure 6:
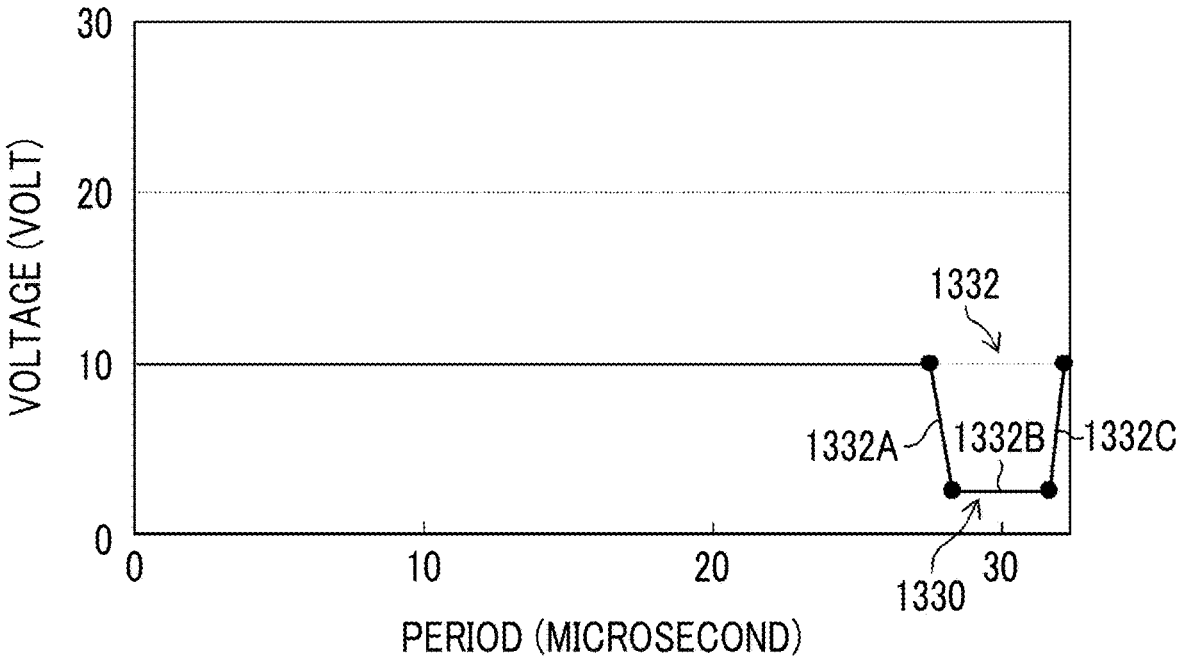
FIG. 6 is an explanatory view of a meniscus fluctuation drive voltage.

FIG. 6 is an explanatory view of the meniscus fluctuation drive voltage. FIG. 6 illustrates a meniscus fluctuation drive voltage 1330, using a graph form. The horizontal axis is the period. The unit of the period is microsecond. The vertical axis is the voltage. The unit of voltage is volts.

The meniscus fluctuation drive voltage 1330 illustrated in FIG. 6 is used when the ink 1008 is vibrated to such a degree that the ink is not jetted from the nozzle 1002. The meniscus fluctuation drive voltage 1330 includes one fluctuation pulse 1332.

A piezoelectric element supplied with a fourth waveform element 1332A of the fluctuation pulse 1332 pressurizes the ink liquid surface 1010 toward the outside of the nozzle 1002. The period of a fifth waveform element 1332B vibrates according to the natural period $T_0$ of the ink liquid surface 1010. A piezoelectric element supplied with a sixth waveform element 1332C pressurizes the ink liquid surface 1010 toward the inside of the nozzle 1002.

In the present embodiment, trapezoidal waveforms of positive logic are exemplified as examples of the overflow pulse, the jetting pulse, and the fluctuation pulse. Trapezoidal waveforms of negative logic can be applied to the overflow pulse, the jetting pulse, and the fluctuation pulse. In the case of the trapezoidal waveforms of negative logic, a maximum potential in the case of the trapezoidal waveforms of positive logic may be replaced as a minimum potential.

[Explanation of Overflow Pulse]

Figure 7:
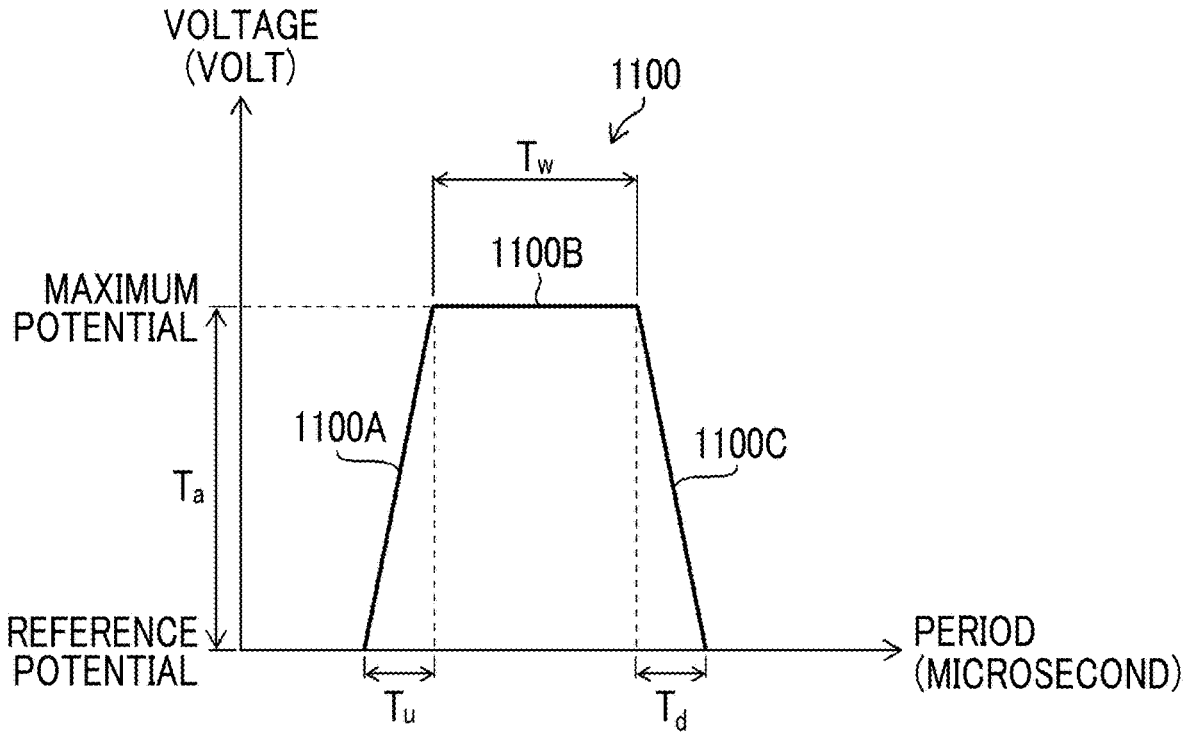
FIG. 7 is an explanatory view of a pulse waveform included in an overflow waveform.

FIG. 7 is an explanatory view of the overflow pulse included in the overflow drive voltage. FIG. 7 illustrates one overflow pulse 1100 included in the overflow drive voltage 1300, using a graph form. The overflow pulse 1100 is specified with the pulse width $T_W$, an amplitude $T_a$, a rising period $T_u$, and a falling period $T_d$ as parameters.

The pulse width $T_W$ represents the period of maximum potential. The unit of the pulse width $T_W$ is microsecond. The amplitude $T_a$ represents a potential difference from the reference potential to the maximum potential. The unit of the amplitude $T_a$ is volt. The rising period $T_u$ represents a period from the reference potential to the maximum potential. The falling period $T_d$ represents a period from the maximum potential to the reference potential. The unit of the rising period $T_u$ and the falling period $T_d$ is microsecond.

[Overflow Waveform Parameters]

Hereinafter, an example in which the parameters of the overflow pulse 1100 illustrated in FIG. 7 are experimentally derived will be described below. The continuous printing is performed using an ink jet head, and immediately after that, the overflow processing is performed. The overflow drive voltage 1300 illustrated in FIG. 4 was applied to the overflow processing. The ink jet head 1000 and the ink 1008 used are as shown in the following Table 1.

TABLE 1

| | | | |
|---|---|---|---|
| Ink Jet Head | samba G3L | | Made by FUJIFILM Corporation |
| Ink | C-WP-QK | | Made by FUJIFILM Corporation |
| | Viscosity | 5.4 mPa · S | |
| | Surface tension | 36.6 mN/m | |
| | Static contact angle | 85.0° | |

mPa·s in the above Table 1 represents millipascal seconds. mN/m represents millinewtons per meter. The static contact angle represents the contact angle of ink with respect to a liquid repellent film formed on the nozzle surface. FDTS (1H, 1H, 2H, 2H perfluorodecyl-trichlorosilane) was applied to the liquid repellent film.

By changing the pulse width $T_W$, the amplitude $T_a$, the rising period $T_u$, and the falling period $T_d$, + continuous printing and overflow processing were performed, and the nozzle surface 1004 to which the ink 1012 illustrated in FIG. 1 was caused to overflow was enlarged and observed. As an example of the observation result of the nozzle surface 1004, an enlarged photograph with reference sign 1B and reference sign 1F are given in FIG. 1.

The number of items shown in the following Table 2 was given depending on the state of the nozzle surface 1004 to which the ink 1012 was caused to overflow. The determination, the number of items, and the definition of the number of items are as shown in the following Table 2.

TABLE 2

| Determination | Number of Items | Definitions |
|---|---|---|
| Not allowed | 0 | Nozzles with no overflow is 10% or more. |
| Not allowed | 1 | Nozzles with no overflow is less than 10%. |
| Allowed | 2 | All nozzles have overflow. Some nozzles have an ink overflow range of φ2.0 micrometers. |
| Allowed | 3 | All nozzles have overflow. |
| Allowed | 4 | All nozzles have overflow. Some nozzles have an ink overflow range of φ100 micrometers. |
| Not allowed | 5 | Nozzles with overflow is less than 10%. |
| Not allowed | 6 | Nozzles with overflow is 10% or more. |

"Allowed" in the determination column of the above Table 2 represents being applicable to the overflow waveform. "Not Allowed" in the determination column represents not being applicable to the overflow waveform.

Due to the manufacturing error of the ink jet head 1000, a variation is present in the flow channel resistance and the like for each nozzle 1002. Additionally, a variation is present in the performance of a piezoelectric element corresponding to each nozzle 1002.

Even in a case where the same overflow drive voltage is supplied to the piezoelectric elements corresponding to the respective nozzles 1002, the presence or absence of overflow, the overflow range, and the presence or absence of jetting will vary among the nozzles 1002. Thus, a case where the overflow occurs from all the nozzles and the range of the ink 1012 that has overflowed to the nozzle surface 1004 has a diameter on a straight line passing through the center of the nozzle 1002 of 2.0 micrometers or more and 100 micrometers or less was considered as "Allowed".

The overflow range of the ink 1012 that has overflowed to the nozzle surface 1004 was a maximum value of the distance from the edge of the nozzle 1002 to the edge of the ink 1012 that has overflowed the nozzle surface 1004, on the straight line passing through the center of the opening of the nozzle 1002.

The pulse width $T_W$ was set to 1.0, 1.2, 1.5, 1.8, and 2.0 in a case where the pulse width of a jetting waveform was 1.0. The amplitude $T_a$ was set to 1.0, 0.8, 0.5, 0.3, and 0.1 in a case where the amplitude of the jetting waveform was 1.0.

The following Table 3 shows the result in a case where the rising period $T_u$ and the falling period $T_d$ are 0.3 times the pulse width $T_W$.

TABLE 3

| | | Pulse Width | | | | |
|---|---|---|---|---|---|---|
| | | 1.0 | 1.2 | 1.5 | 1.8 | 2.0 |
| Amplitude | 1.0 | 6 | 6 | 5 | 5 | 0 |
| | 0.8 | 6 | 4 | 4 | 3 | 0 |
| | 0.5 | 6 | 4 | 3 | 2 | 0 |
| | 0.3 | 5 | 3 | 2 | 2 | 0 |
| | 0.1 | 0 | 0 | 0 | 0 | 0 |

According to the above Table 3, the pulse width $T_W$ may be 1.2 times or more and 1.8 times or less the pulse width of the jetting pulse, and the amplitude $T_a$ may be 0.3 times or more and 0.8 times or less the amplitude of the jetting pulse. The pulse width of the jetting waveform may be a minimum value of the pulse width of the jetting pulse in the case of the jetting drive voltage including a plurality of pulses. The amplitude of the jetting waveform may be a maximum value of the amplitude of the jetting waveform in the case of the jetting waveform including a plurality of pulses.

The following Table 4 shows the results in a case where the rising period $T_u$ and the falling period $T_d$ are 0.4 times the pulse width $T_W$.

TABLE 4

| | | Pulse Width | | | | |
|---|---|---|---|---|---|---|
| | | 1.0 | 1.2 | 1.5 | 1.8 | 2.0 |
| Amplitude | 1.0 | 6 | 5 | 5 | 0 | 0 |
| | 0.8 | 6 | 2 | 2 | 0 | 0 |
| | 0.5 | 5 | 2 | 0 | 0 | 0 |

TABLE 4-continued

| | | Pulse Width | | | | |
|---|---|---|---|---|---|---|
| | | 1.0 | 1.2 | 1.5 | 1.8 | 2.0 |
| | 0.3 | 5 | 0 | 0 | 0 | 0 |
| | 0.1 | 0 | 0 | 0 | 0 | 0 |

According to the above Table 4, the pulse width $T_W$ may be 1.2 times or more and 1.5 times or less the pulse width of the jetting pulse, and the amplitude $T_a$ may be 0.8 times the amplitude of the jetting pulse. Additionally, the pulse width $T_W$ may be 1.2 times the pulse width of the jetting pulse, and the amplitude $T_a$ may be 0.5 times or more and 0.8 times or less the amplitude of the jetting pulse.

Summarizing the parameters of the overflow pulse 1100 described above, the conditions shown in the following Table 5 can be applied to the parameters of the overflow pulse 1100.

TABLE 5

| | |
|---|---|
| Pulse Width $T_w$ | 1.2 times or more and 1.8 times or less |
| Amplitude $T_a$ | 0.3 times or more and 0.8 times or less |
| Rising Period $T_u$ | 0.3 times or less of pulse width $T_w$ |
| Falling Period $T_d$ | 0.3 times or less of pulse width $T_w$ |

Although the rising period $T_u$ and the falling period $T_d$ have the same value, different values may be applied to the rising period $T_u$ and the falling period $T_d$. Both the rising period $T_u$ and the falling period $T_d$ contribute to the acceleration of the ink liquid surface 1010. Then, even in a case where at least one of the rising period $T_u$ or the falling period $T_d$ satisfies 0.3 times or less of the pulse width $T_W$, it is presumed that the same results as in the above Table 3 are obtained.

In the experimental results shown in the above Table 4, the combination of the pulse width $T_W$ and the amplitude $T_a$ at which the ink 1008 does not overflow to the nozzle surface 1004 is a combination of the pulse width $T_W$ and the amplitude $T_a$ at which the ink 1008 overflows to the nozzle surface 1004 in the experimental results shown in Table 3.

That is, in a case where the rising period $T_u$ and the falling period $T_d$ are relatively short, the ink 1008 tends to overflow onto the nozzle surface 1004. Therefore, in a case where the rising period $T_u$ and the falling period $T_d$ are less than 0.3 times the pulse width $T_W$, and in a case where the rising period $T_u$ and the falling period $T_d$ are 0.3 times the pulse width $T_W$, it can be presumed that at least the same results are obtained. Thus, the conditions of the rising period $T_u$ and the falling period $T_d$ were set to 0.3 times or less of the pulse width $T_W$.

[Conditions for Overflow Period]

Next, the conditions for the overflow period will be described. The overflow period represents a period in which the overflow drive voltage is supplied to the piezoelectric elements.

Continuous printing of a specified number of sheets are performed using the above-described ink jet head and ink. The specified number is 3000. Immediately after the continuous printing, the deviation of a landing position is measured. The overflow processing is performed. Immediately after the overflow processing is performed, the deviation of the landing position is measured. Similar experiments are performed in a case where the overflow period is 0.1 seconds, 0.2 seconds, 1 second, 10 seconds, and 60 seconds.

The landing position deviation was measured by printing a nozzle check pattern, reading the nozzle check pattern using a reading device such as a scanner, and deriving the analysis result of the nozzle check pattern.

The above overflow period was realized by changing the number of overflow pulses 1100 included in the overflow drive voltage 1300. The above overflow period was realized by specifying the number of overflow pulses 1100 within the unit period and adjusting the number of repetitions of the unit period to adjust the number of overflow pulses 1100. The cycle of the overflow pulse 1100 is determined on the basis of the number of overflow pulses 1100 in a unit period. The number of overflow pulses 1100 included in the overflow drive voltage 1300 corresponds to the specified number of pulses included in the overflow waveform.

In addition, the realization of the overflow period is not limited to the above example. The overflow period can be appropriately determined depending on the configuration of an electric circuit that generates the overflow drive voltage 1300. The following Table 6 shows the experimental results during the overflow period.

TABLE 6

| Overflow Period (seconds) | | | | |
|---|---|---|---|---|
| 0.1 | 0.2 | 1.0 | 10.0 | 60.0 |
| C | B | B | A | A |

Evaluation A in the above Table 6 shows a case where the ratio of nozzles of which the jetting state has been improved to all the nozzles is 90% or more. Evaluation B shows a case where the ratio of nozzles of which the jetting state has been improved to all the nozzles is 80% or more and less than 90%. Evaluation C shows a case where the ratio of nozzles of which the jetting state has been improved to all the nozzles is less than 80%.

In a case where the deviation of the landing position after the overflow processing was 20% or more smaller than the deviation of the landing position before the overflow processing, it was determined that the jetting state was improved. According to the above Table 6, it is possible to improve the jetting state in a case where the overflow period is 0.2 seconds or more.

In addition, in a case where the overflow period is relatively long, a higher effect tends to be obtained. Although not shown in the above Table 6, in a case where the overflow period is 90 seconds, it is considered that it is possible to obtain at least the same effect as in a case where the overflow period is 60 seconds. The overflow period may be specified as 0.2 seconds or more and 90 seconds or less.

[Conditions for Statically Determinate Period]

Next, the conditions for the statically determinate period will be described. The statically determinate period represents a period from the termination timing of the overflow drive voltage 1300 to the start of printing. In a case where the overflow drive voltage 1300 is configured to include a plurality of overflow pulses 1100, the termination timing of the overflow drive voltage 1300 may be the termination of the final overflow pulse 1100. The following Table 7 shows the experimental results during the overflow period.

TABLE 7

| Statically Determinate Period (seconds) | | | | |
|---|---|---|---|---|
| 0.1 | 0.5 | 1.0 | 10.0 | 60.0 |
| C | B | B | A | A |

Evaluation A in the above Table 7 shows a case where the ratio of nozzles of which the jetting state has deteriorated to all the nozzles is less than 0.2%. Evaluation B shows a case where the ratio of nozzles of which the jetting state has deteriorated to all the nozzles is 0.2% or more and less than 0.5%. Evaluation C shows a case where the ratio of the nozzles of which the jetting state has deteriorated to all the nozzles is 0.5% or more.

In a case where the deviation of the landing position after the overflow processing was 20% or more larger than the deviation of the landing position before the overflow processing, it was determined that the jetting state was deteriorated. According to the above Table 7, the jetting state is not deteriorated in a case where the statically determinate period is 0.5 seconds or more.

In addition, in a case where the statically determinate period is relatively long, a higher effect tends to be obtained. Although not shown in the above Table 7, it is considered that it is possible to obtain at least the same effect as in a case where the overflow period is 60 seconds in a case where the statically determinate period is 120 seconds. The statically determinate period may be specified as 0.5 seconds or more and 120 seconds or less.

[Regarding Ink Jet Head and Ink Application Range]

Although the above Tables 3 to 7 show the conditions of the overflow processing based on the experimental results using the ink jet head and ink shown in Table 1, the conditions of the overflow processing shown in the above Tables 3 to 7 can be applied to those other than the ink jet head and ink shown in the above Table 1.

In the overflow processing described in the present embodiment, in the ink jet head 1000 using the piezoelectric elements, a jetting mechanism utilizing the resonance phenomenon of the ink liquid surface 1010 is applied, and the resonance phenomenon of the ink liquid surface 1010 is utilized to cause the ink 1012 to overflow from the nozzle 1002 to the nozzle surface 1004.

Also, the parameters of the overflow pulse 1100 are specified with reference to the parameters of the jetting pulse 1200. Therefore, the parameters of the overflow pulse, the overflow period, and the statically determinate period shown in Tables 3 to 7 based on the above experimental results can be applied to the ink jet head and the ink shown in Table 1.

[Configuration Example of Ink Jet Head Drive Unit]

Next, an ink jet head drive unit that enables the realization of the above-described overflow processing will be described. The ink jet head drive unit corresponds to an example of a jetting head drive unit.

[Hardware Configuration of Ink Jet Head Drive Unit]

Figure 8:
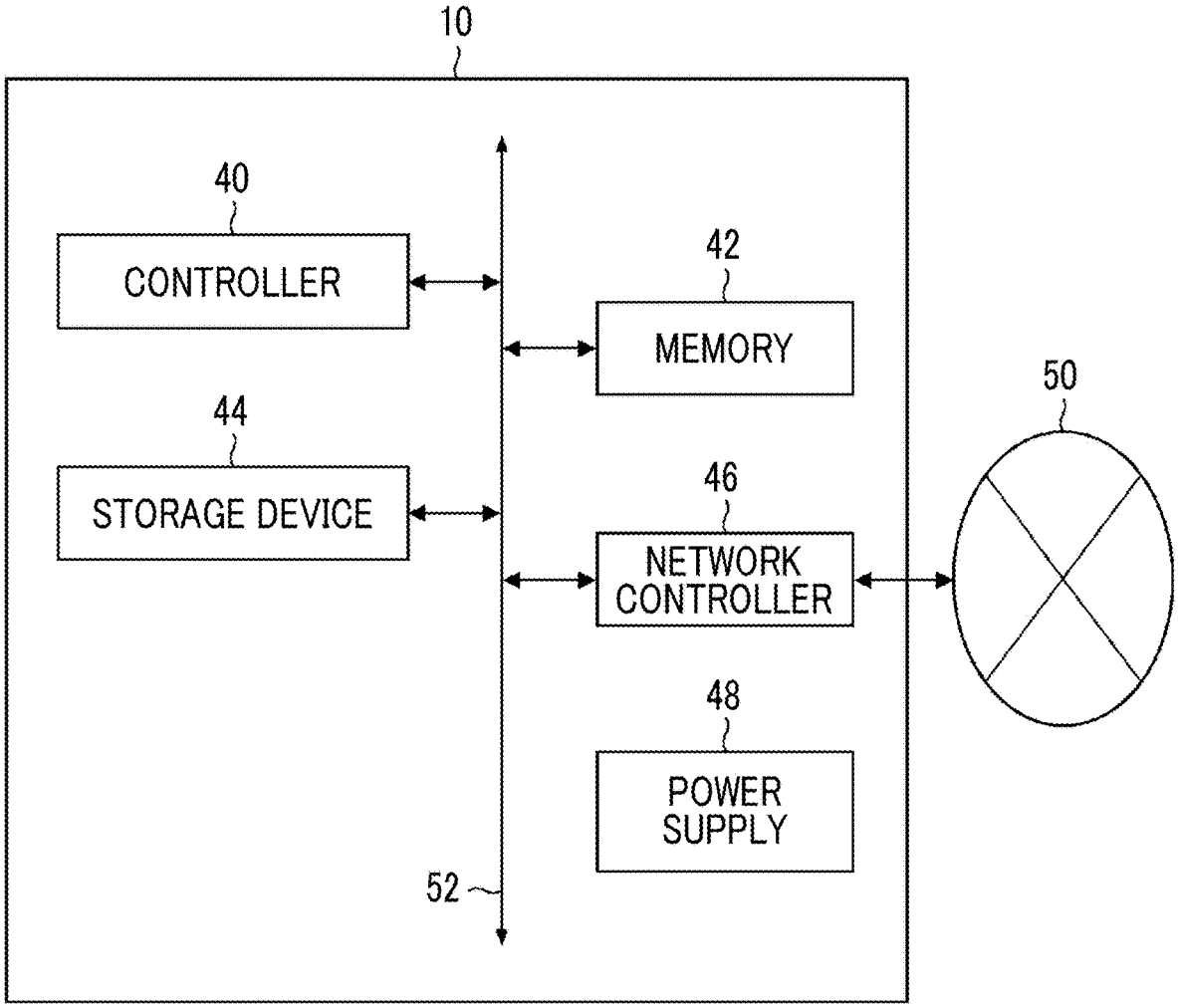
FIG. 8 is a block diagram illustrating a hardware configuration of an ink jet head drive unit.

FIG. 8 is a block diagram illustrating a hardware configuration of the ink jet head drive unit. The ink jet head drive unit 10 can realize various functions of the ink jet head drive unit 10 by executing a specified program using the hardware illustrated in FIG. 8.

The ink jet head drive unit 10 includes a controller 40, a memory 42, a storage device 44, a network controller 46, and a power supply 48. The controller 40, the memory 42, the storage device 44, and the network controller 46 are connected via a bus 52 so that data communication is possible.

<Controller>

The controller 40 functions as an overall controller, various calculation units, and a storage controller of the ink jet head drive unit 10. The controller 40 executes a program stored in a ROM (read only memory) provided in the memory 42.

The controller 40 may download the program from an external storage device via the network controller 46 and execute the downloaded program. The external storage device may be communicably connected to the ink jet head drive unit 10 via the network 50.

The controller 40 uses a RAM (random access memory) provided in the memory 42 as a calculation region, and executes various processing in cooperation with various programs. Accordingly, the various functions of the ink jet head drive unit 10 are realized.

The controller 40 controls the reading of data from the storage device 44 and the writing of data to the storage device 44. The controller 40 may acquire various data from the external storage device via the network controller 46. The controller 40 can execute various processing such as calculation using the acquired various data.

The controller 40 may include one or more processors. Examples of the processor include a field programmable gate array (FPGA) and a programmable logic device (PLD). The FPGA and the PLD allow the circuit configuration to be changed after manufacturing.

Another example of the processor includes an application specific integrated circuit (ASIC). The ASIC includes a circuit configuration exclusively designed to execute specific processing.

Two or more same types of processors can be applied as the controller 40. For example, two or more FPGAs or two PLDs may be used as the controller 40. Two or more different types of processors may be applied as the controller 40. For example, one or more FPGAs and one or more ASICs may be applied as the controller 40.

In a case where a plurality of the controllers 40 are provided, the plurality of controllers 40 may be configured by using one processor. As an example in which the plurality of controllers 40 is configured by one processor, there is a form in which one processor is configured using a combination of one or more central processing units (CPUs) and software, and the processor function as the plurality of controllers 40. Instead of the CPU or in combination with the CPU, a graphics processing unit (GPU) that is a processor specialized for image processing may be applied. In addition, the software here is synonymous with the program. Typical examples in which the plurality of controllers 40 are configured by using one processor include computers such as a client device and a server device.

Another example in which the plurality of controllers 40 is configured by one processor includes a form in which a processor that realizes the functions of the entire system including the plurality of controllers 40 with a single IC chip is used. A typical example of a processor that realizes the functions of the entire system including the plurality of controllers 40 with a single IC chip includes a system on chip (SoC). In addition, IC is an abbreviation for Integrated Circuit.

In this way, the controller 40 is configured by using one or more various processors as a hardware structure.

<Memory>

The memory 42 includes a ROM (not illustrated) and a RAM (not illustrated). The ROM stores various programs executed in the ink jet head drive unit 10. The ROM stores parameters, files, and the like used for executing the various programs. The RAM functions as a temporary storage region for data, a work region for the controller 40, and the like.

<Storage Device>

The storage device 44 stores various data non-temporarily. The storage device 44 may be externally attached to the outside of the ink jet head drive unit 10. A large-capacity semiconductor memory device may be applied instead of or in combination with the storage device 44.

<Network Controller>

The network controller 46 controls data communication with an external device. The control of the data communication may include the management of traffic for the data communication. A publicly known network such as a local area network (LAN) can be applied as the network 50 connected via the network controller 46.

<Power Supply>

A large-capacity power supply such as an uninterruptible power supply (UPS) is applied as the power supply 48. The power supply 48 supplies power to the ink jet head drive unit 10 in a case where a commercial power supply is cut off due to a power failure or the like. In addition, the hardware configuration of the ink jet head drive unit 10 illustrated in FIG. 8 is an example, and additions, deletions, and changes can be appropriately made.

[Functions of Ink Jet Head Drive Unit]

Figure 9:
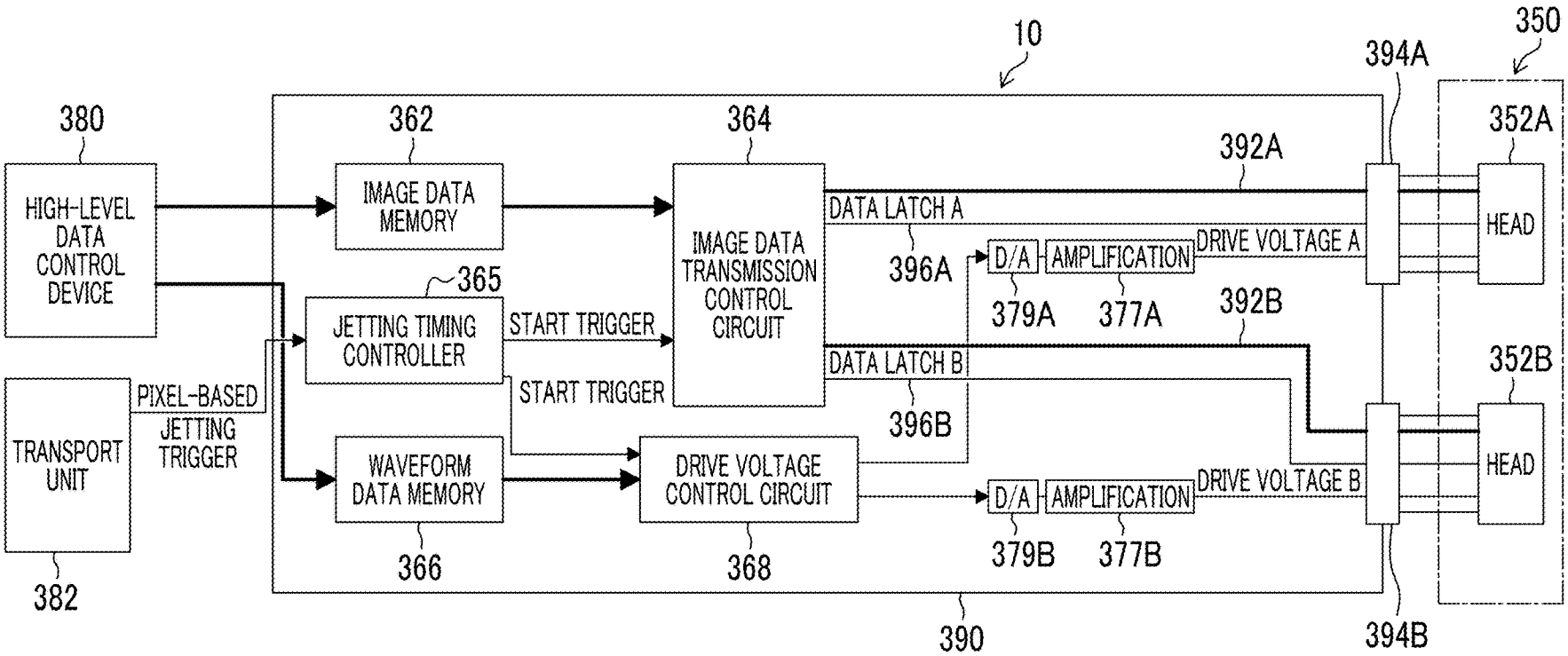
FIG. 9 is a functional block diagram of the ink jet head drive unit.

FIG. 9 is a functional block diagram of the ink jet head drive unit. An ink jet head 350 illustrated in FIG. 9 is configured by combining a plurality of head modules. FIG. 9 illustrates a head module 352A and a head module 352B. In addition, the number of head modules that constitute the ink jet head 350 is not particularly limited.

In the following description, reference sign 352 is used to represent a general term of a plurality of head modules or any one of a plurality of head modules.

The ink jet head drive unit 10 is connected to the ink jet head 350. The ink jet head drive unit 10 controls driving of piezoelectric elements corresponding to the respective nozzles provided in the head module 352, and controls ink jetting operation from the nozzles. The control of the ink jetting operation described herein includes the control of the presence or absence of jetting, the control of liquid droplet jetting amount, and the like.

Additionally, the ink jet head drive unit 10 supplies the overflow drive voltage 1300 to the ink jet head 350 to control the overflow processing of the ink jet head 350. Moreover, the ink jet head drive unit 10 supplies a meniscus fluctuation drive voltage 1330 to the ink jet head 350 to control the meniscus fluctuation processing of the ink jet head 350.

The ink jet head drive unit 10 includes an image data memory 362, an image data transmission control circuit 364, a jetting timing controller 365, a waveform data memory 366, and a drive voltage control circuit 368. The ink jet head drive unit 10 includes a digital-to-analog converter 379A, a digital-to-analog converter 379B, a power amplification circuit 377A, and a power amplification circuit 377B.

The image data transmission control circuit 364 illustrated in FIG. 9 includes a latch signal transmission circuit (not illustrated). A data latch signal is output at an appropriate timing from the image data transmission control circuit 364 to the ink jet head 350. In addition, the data latch signal is a general term for a data latch A and a data latch B illustrated in FIG. 9. The data latch signal may represent either data latch A or data latch B.

The image data memory 362 stores image data developed into printing image data. The printing image data is synonymous with dot data. The image data may include nozzle check pattern image data used in a case where a nozzle check pattern is formed.

The waveform data memory 366 stores digital data indicating the waveform of the drive voltage supplied to the piezoelectric elements. Examples of the waveform of the drive voltage include the overflow waveform of the overflow drive voltage 1300 illustrated in FIG. 4, the jetting waveform of the jetting drive voltage 1310 illustrated in FIG. 5, and the meniscus fluctuation waveform of the meniscus fluctuation drive voltage 1330 illustrated in FIG. 7.

The image data input to the image data memory 362 and the waveform data input to the waveform data memory 366 are managed in the high-level data control device 380. A computer can be applied to a high-level data control device 380. The waveform data memory 366 corresponds to an example of a drive waveform acquisition unit.

The ink jet head drive unit 10 includes a communication interface that receives data from the high-level data control device 380. An example of the communication interface includes a universal serial bus (USB).

In a case where a plurality of ink jet heads 350 are provided, each ink jet head 350 is individually provided with the ink jet head drive unit 10. An example in which the plurality of ink jet heads 350 are provided includes an aspect in which the ink jet heads 350 corresponding to cyan ink, magenta ink, yellow ink, and black ink are provided. The plurality of ink jet head drive units 10 can be managed by using one high-level data control device 380.

In a case where the system of the ink jet printer is started, the waveform data and the image data are transmitted from the high-level data control device 380 to the ink jet head drive unit 10 for each color. The image data may be transmitted in synchronization with the transport of paper during the execution of printing.

Then, during the operation of the ink jet head 350, the jetting timing controller 365 receives a pixel-based jetting trigger signal from a transport unit 382. The pixel-based jetting trigger signal may be referred to as a printing timing signal or the like.

The jetting timing controller 365 outputs a start trigger for starting the jetting operation to the image data transmission control circuit 364 and the drive voltage control circuit 368.

The image data transmission control circuit 364 receives the start trigger and transmits the image data to each head module 352 in units of resolution. The drive voltage control circuit 368 receives the start trigger and transmits the waveform data in units of resolution. This realizes printing based on jetting drive control of a selective drop-on-demand according to the image data.

Drive voltage waveform data is output from the drive voltage control circuit 368 to the digital-to-analog converter 379 in accordance with the start trigger. In addition, the digital-to-analog converter 379 is a general term for the digital-to-analog converter 379A and the digital-to-analog converter 379B illustrated in FIG. 9. The digital-to-analog converter 379 may represent either the digital-to-analog converter 379A or the digital-to-analog converter 379B.

The digital-to-analog converter 379 converts digital-format waveform data into an analog-format voltage waveform. The output waveform of the digital-to-analog converter 379 is amplified to a current and a voltage suitable for driving the piezoelectric elements by using the power amplification circuit 377. An example of the power amplification circuit includes an amplifier circuit. The drive voltage output from the power amplification circuit 377 is supplied to the head module 352. In addition, the power amplification circuit 377 is a general term for the power amplification circuit 377A and the power amplification circuit 377B illustrated in FIG. 9. The power amplification circuit 377 may represent either the power amplification circuit 377A or the power amplification circuit 377B.

The digital-to-analog converter 379 and the power amplification circuit 377 are examples of constituent elements of a drive voltage generation unit. Additionally, the image data transmission control circuit 364, the drive voltage control circuit 368, the digital-to-analog converter 379, and the power amplification circuit 377 are constituent elements of a drive voltage supply unit.

The image data transmission control circuit 364 performs the control of transmitting the nozzle control data of each head module 352 to each head module 352 on the basis of the data stored in the image data memory 362.

The nozzle control data described herein is image data corresponding to the dot arrangement of recording resolution. In other words, the nozzle control data is image data for determining jetting drive or non-drive of the nozzles. In addition, the jetting drive of the nozzles is sometimes referred to as ON of the nozzles. The non-drive of the nozzles is sometimes referred to as OFF of the nozzles.

The image data transmission control circuit 364 transmits the nozzle control data to each head module 352. Accordingly, the jetting drive or non-drive for each nozzle is controlled.

An image data transmission line 392 that transmits the nozzle control data output from the image data transmission control circuit 364 to each head module 352 is referred to as an image data bus, a data bus, an image bus, or the like. In addition, the image data transmission line 392 is a general term for an image data transmission line 392A and an image data transmission line 392B illustrated in FIG. 9. The image data transmission line 392 may represent either the image data transmission line 392A or the image data transmission line 392B illustrated in FIG. 9.

The image data transmission line 392 is configured by using a plurality of signal lines. One end of the image data transmission line 392 is connected to an output terminal of the image data transmission control circuit 364. The other end of the image data transmission line 392 is connected to the head module 352 via a connector 394 corresponding to each head module 352. In addition, the connector 394 is a general term for the connector 394A, and the connector 394B illustrated in FIG. 9.

The image data transmission line 392 may be configured by a copper wire pattern of an electric circuit board 390 on which the image data transmission control circuit 364, the drive voltage control circuit 368, and the like are mounted. The image data transmission line 392 may be configured using a wire harness. The image data transmission line 392 may be configured by combining the copper wire pattern of the electric circuit board 390 and a wire harness.

A signal line 396 for the data latch signal corresponding to each head module 352 is provided for each head module 352. The signal line 396 is a general term for a signal line 396A and a signal line 396B illustrated in FIG. 9. The signal line 396 may represent either the signal line 396A or the signal line 396B.

The data latch signal is transmitted at a necessary timing from the image data transmission control circuit 364 to each head module 352 in order to set the data signal transmitted via the image data transmission line 392 as the nozzle data of each head module 352.

The image data transmission control circuit 364 transmits the latch signal to the head module 352 at the time when a certain amount of image data is transmitted to the head module 352 via the image data transmission line 392.

At the timing indicated by the latch signal, the jetting drive or non-drive data of the piezoelectric elements in each head module 352 is determined. Thereafter, a drive voltage is supplied to the head module 352, and the piezoelectric elements related to the jetting drive setting are deformed to jet ink. The ink jetted in this way is made to adhere to a medium, and printing with a desired resolution is performed.

The adhesion of ink to the medium may be referred to as landing. An example of the desired resolution includes 1200 dots per inch. In addition, the piezoelectric element set to the non-drive is not displaced even in a case where the drive voltage is supplied, and ink is not jetted. In addition, the drive voltage is a general term for a drive voltage A and a drive voltage B illustrated in FIG. 9.

In the present embodiment, an aspect in which the drive waveform is acquired from the high-level data control device 380 has been exemplified, but the ink jet head drive unit 10 may include a drive waveform generation unit that generates the drive waveform.

The drive waveform generation unit may include a parameter setting unit that sets the parameters of the drive waveform. The drive waveform generation unit may include an overflow period setting unit that sets the overflow period. The overflow period setting unit may set the number of overflow pulses.

The ink jet head drive unit 10 may include an input unit that inputs the parameters of the drive waveform. The ink jet head drive unit 10 may include a display unit that displays the parameters of the drive waveform, the overflow period, and the statically determinate period.

[Configuration Example of Ink Jet Head]

[Overall Configuration of Ink Jet Head]

Figure 10:
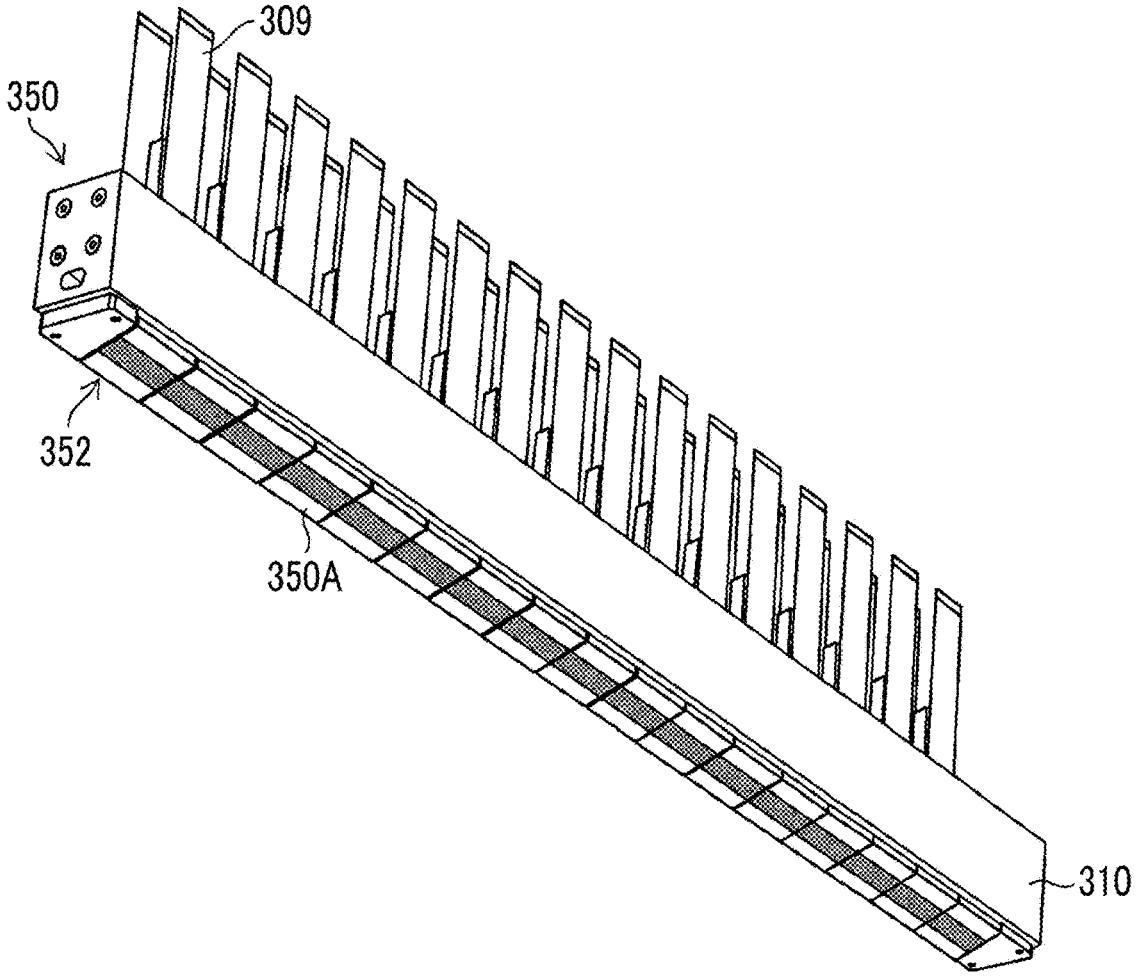
FIG. 10 is a perspective view illustrating a configuration of a tip portion of an ink jet head.

FIG. 10 is a perspective view illustrating the configuration of a tip portion of the liquid jetting head. The ink jet head 350 is a line type ink jet head having a nozzle line capable of performing image recording with a specified recording resolution by performing single scanning on the entire recording region of the medium in the width direction of the medium. Such an ink jet head is also referred to as a full line type ink jet head or a page wide head. The width direction of the medium is a direction orthogonal to a transport direction of the medium and is a direction parallel to the printing surface of the medium.

The tip portion of the ink jet head 350 has a nozzle surface 350A. Nozzle openings of the nozzles that jet ink is formed in the nozzle surface 350A. The tip portion of the ink jet head 350 includes the end of the ink jet head 350 on the side where ink is jetted. In addition, the nozzle surface 350A illustrated in FIG. 10 corresponds to the nozzle surface 1004 illustrated in FIG. 1.

The ink jet head 350 has a structure in which the plurality of head modules 352 are connected to each other in a line in a longitudinal direction. The head module 352 is attached to and integrated with a support frame 310. A constituent element denoted by reference sign 309 in FIG. 10 is an electrical connection cable that extends from each head module 352.

[Nozzle Arrangement]

Figure 11:
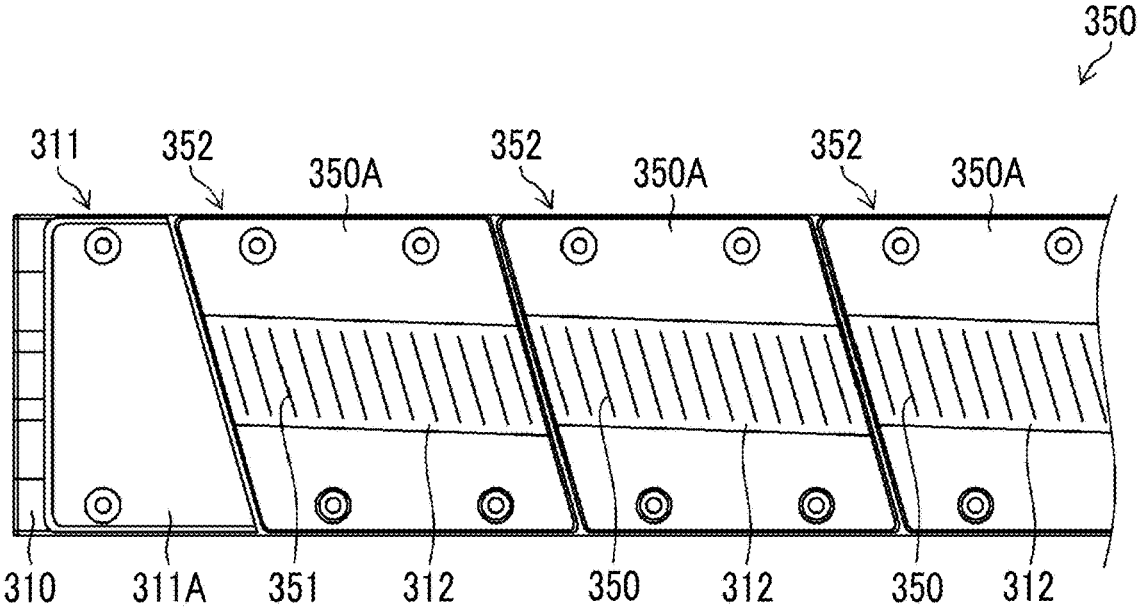
FIG. 11 is a partially enlarged view of the nozzle surface.

FIG. 11 is a partially enlarged view of the nozzle surface. The nozzle surface 350A of the head module 352 has a parallelogram shape. Dummy plates 311 are attached to both ends of the support frame 310. The nozzle surface 350A of the ink jet head 350 has an oblong shape as a whole together with a surface 311A of the dummy plate 311.

A belt-shaped nozzle arrangement unit 312 is provided at a central portion of the nozzle surface 350A of the head module 352. The nozzle arrangement unit 312 functions as a substantial nozzle surface 350A. Nozzles are provided in the nozzle arrangement unit 312. In addition, in FIG. 11, the nozzles are not illustrated individually, but nozzle lines 351 configured by a plurality of nozzles is illustrated.

Figure 12:
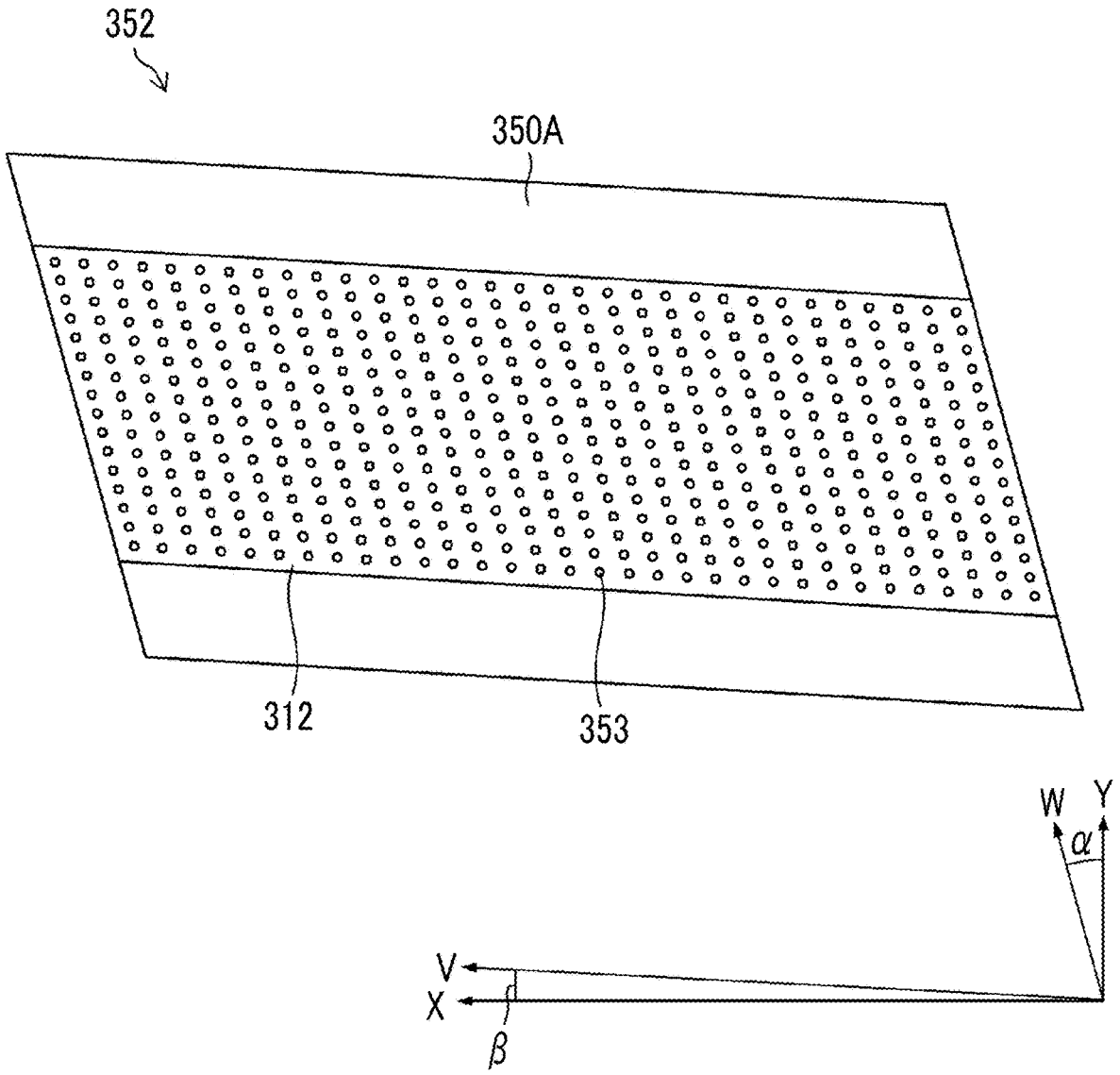
FIG. 12 is a plan view of a nozzle arrangement unit

FIG. 12 is a plan view of the nozzle arrangement unit. Reference sign Y represents the transport direction of the medium. Reference sign X represents the width direction of the medium. A two-dimensional arrangement is applied to the nozzle surface 350A of the head module 352 to arrange a plurality of nozzle openings 353.

The head module 352 has a parallelogram planar shape having an end surface on a long side in a V direction having an inclination of an angle $\beta$ with respect to the width direction of the medium and an end surface on a short side in a W direction having an inclination of an angle $\alpha$ with respect to the transport direction of the medium.

In the head module 352, the plurality of nozzle openings 353 are arranged in a matrix in a row direction along the V direction and a column direction along the W direction. The nozzle openings 353 may be arranged in a row direction along the width direction of the medium and a column direction obliquely intersecting the width direction of the medium.

In the case of the ink jet head in which the plurality of nozzles are arranged in a matrix, it can be considered that a projection nozzle line in which each nozzle in a matrix array is projected in a nozzle line direction is equivalent to one nozzle line in which the respective nozzles are lined up at approximately regular intervals with a nozzle density such that a maximum recording resolution is achieved in the nozzle line direction. The projection nozzle line is a nozzle line in which each nozzle in a two-dimensional nozzle array is orthographically projected in the nozzle line direction.

The "approximately regular intervals" means that droplet jetting points capable of being recorded in the ink jet printer have substantially regular intervals. For example, even in a case where a slightly different interval is included in consideration of at least one of manufacturing error or movement of liquid droplets on the medium due to landing interference, the concept of regular intervals is also included. The projection nozzle line corresponds to a substantial nozzle line. Considering the projection nozzle line, it is possible to associate each nozzle with a nozzle number indicating a nozzle position in line-up order of the projection nozzles lined up in the nozzle line direction.

The array form of the nozzles of the ink jet head 350 is not limited, and various nozzle array forms can be adopted. For example, instead of a matrix-shaped two-dimensional array form, a single-line linear array, a V-shaped nozzle array, and a polygonal-lined nozzle array such as a W-shaped array having a V-shaped array as a repeating unit are also available.

[Configuration Example of Ejector]

Figure 13:
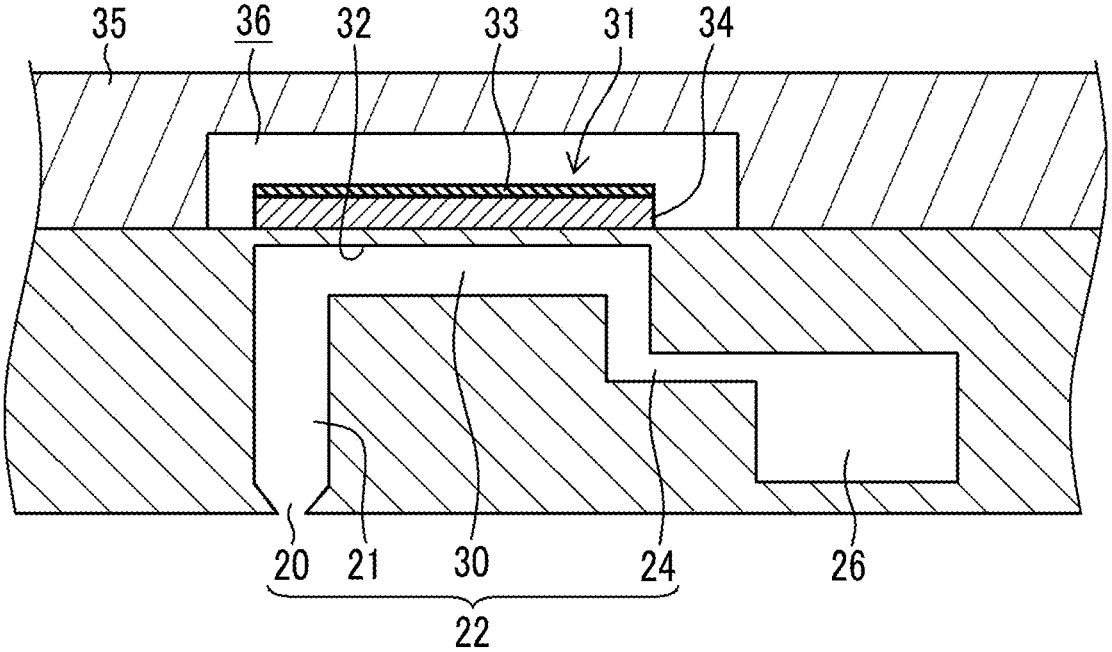
FIG. 13 is a longitudinal sectional view illustrating a three-dimensional structure of an ejector.

FIG. 13 is a longitudinal sectional view illustrating the three-dimensional structure of an ejector. The ejector 22 includes a nozzle 20, a pressure chamber 30 communicating with the nozzle 20, and a piezoelectric element 31. The nozzle 20 illustrated in FIG. 13 corresponds to the nozzle 1002 illustrated in FIG. 1.

The nozzle 20 communicates with the pressure chamber 30 via a nozzle flow channel 21. The pressure chamber 30 communicates with a supply-side common branch flow channel 26 via an individual supply passage 24. In addition, the opening at the tip of the nozzle 20 illustrated in FIG. 13 corresponds to the nozzle opening 353 illustrated in FIG. 12.

A vibration plate 32 that constitutes a top surface of the pressure chamber 30 includes a conductive layer that functions as a common electrode corresponding to a lower electrode of the piezoelectric element 31. In addition, the illustration of the conductive layer is omitted. The pressure chamber 30, wall portions of the other flow channel portions, the vibration plate 32, and the like can be made of silicon.

The material of the vibration plate 32 is not limited to silicon, and an aspect is also possible in which the vibration plate may be formed of a non-conductive material such as resin. The vibration plate 32 itself may be made of a metallic material such as stainless steel to serve as a common electrode.

A piezoelectric unimorph actuator is configured by a structure in which the piezoelectric element 31 is laminated on the vibration plate 32. A drive voltage is applied to the individual electrode 33, which is an upper electrode of the piezoelectric element 31, to deform a piezoelectric body 34 and the vibration plate 32 is bent to change the volume of the pressure chamber 30. A pressure change accompanying the volume change of the pressure chamber 30 acts on ink, and the ink is jetted from the nozzle 20.

In a case where the piezoelectric element 31 returns to its original state after ink is jetted, the pressure chamber 30 is filled with new ink from the supply-side common branch flow channel 26 through the individual supply passage 24. The operation of filling the pressure chamber 30 with the ink is referred to as refilling.

The shape, in plan view, of the pressure chamber 30 is not particularly limited and may be various forms such as a quadrangular shape or other polygonal shapes, a circular shape, or an elliptical shape. A cover plate 35 illustrated in FIG. 13 is a member that keeps a movable space 36 of the piezoelectric element 31 and seals the periphery of the piezoelectric element 31.

Above the cover plate 35, a supply-side ink chamber and a recovery-side ink chamber (not illustrated) are formed. The supply-side ink chamber is coupled to a supply-side common main flow channel (not illustrated) via a communication passage (not illustrated). The recovery-side ink chamber is coupled to a recovery-side common main flow channel (not illustrated) via a communication passage (not illustrated).

[Operational Effects]

According to the ink jet head drive unit 10 described above, the following operational effects can be obtained.

[1]

The pulse width $T_W$ of the overflow pulse 1100 is set to 1.2 times or more and 1.8 times or less the pulse width of the jetting pulse 1200. The amplitude $T_a$ of the overflow pulse 1100 is set to 0.3 times or more and 0.8 times or less that of the jetting pulse 1200. At least one of the rising period $T_u$ or the falling period $T_d$ of the overflow pulse 1100 is set to 0.3 times or less of the pulse width $T_W$ of the overflow pulse 1100. Accordingly, ink can be caused to overflow from the nozzle 1002 to the nozzle surface 1004.

[2]

The overflow period is set to 0.2 seconds or more and 90 seconds or less. Accordingly, it is possible to perform the ink overflow processing in which an outer edge of the overflow range of the ink is within a range of 2.0 micrometers or more and 100 micrometers or less from the edge of the nozzle opening. Additionally, in a case where the ink caused to overflow to the nozzle surface 1004 is recovered, it is suppressed that the ink is torn and a part of the ink remains on the nozzle surface.

[3]

The statically determinate period from the termination timing of the overflow drive voltage to the supply start timing of the jetting drive voltage is set to 0.5 seconds or more and 120 seconds or less. Accordingly, it is possible to avoid jetting abnormality in printing after the overflow processing.

[4]

Based on the jetting pulse 1200, the pulse width $T_W$, the amplitude $T_a$, the rising period $T_u$, and the falling period $T_d$ of the overflow pulse 1100 are specified. Accordingly, the overflow pulse on the basis of the jetting pulse can be specified in a case where the overflow processing of the ink jet head including the pressure element is performed.

[5]

The overflow drive voltage 1300 includes the plurality of overflow pulses 1100. Accordingly, in one overflow pulse 1100, even in a case where the ink 1008 cannot be caused to overflow from the nozzle 1002 to the nozzle surface 1004, the second and subsequent overflow pulses 1100 can act on the ink liquid surface 1010 to overflow the ink 1008 from the nozzle 1002 to the nozzle surface 1004.

[Example of Application to Ink Jet Head Unit]

An ink jet head unit may be configured by combining the ink jet head drive unit 10 illustrated in FIGS. 8 and 9 and the ink jet head 350 described with reference to FIGS. 10 to 13. The ink jet head unit corresponds to an example of the jetting head unit.

[Example of Application to Ink Jet Printer]

Next, an example of application of the above-described ink jet head drive unit 10 to the ink jet printer will be described.

[Overall Configuration of Ink Jet Printer]

Figure 14:
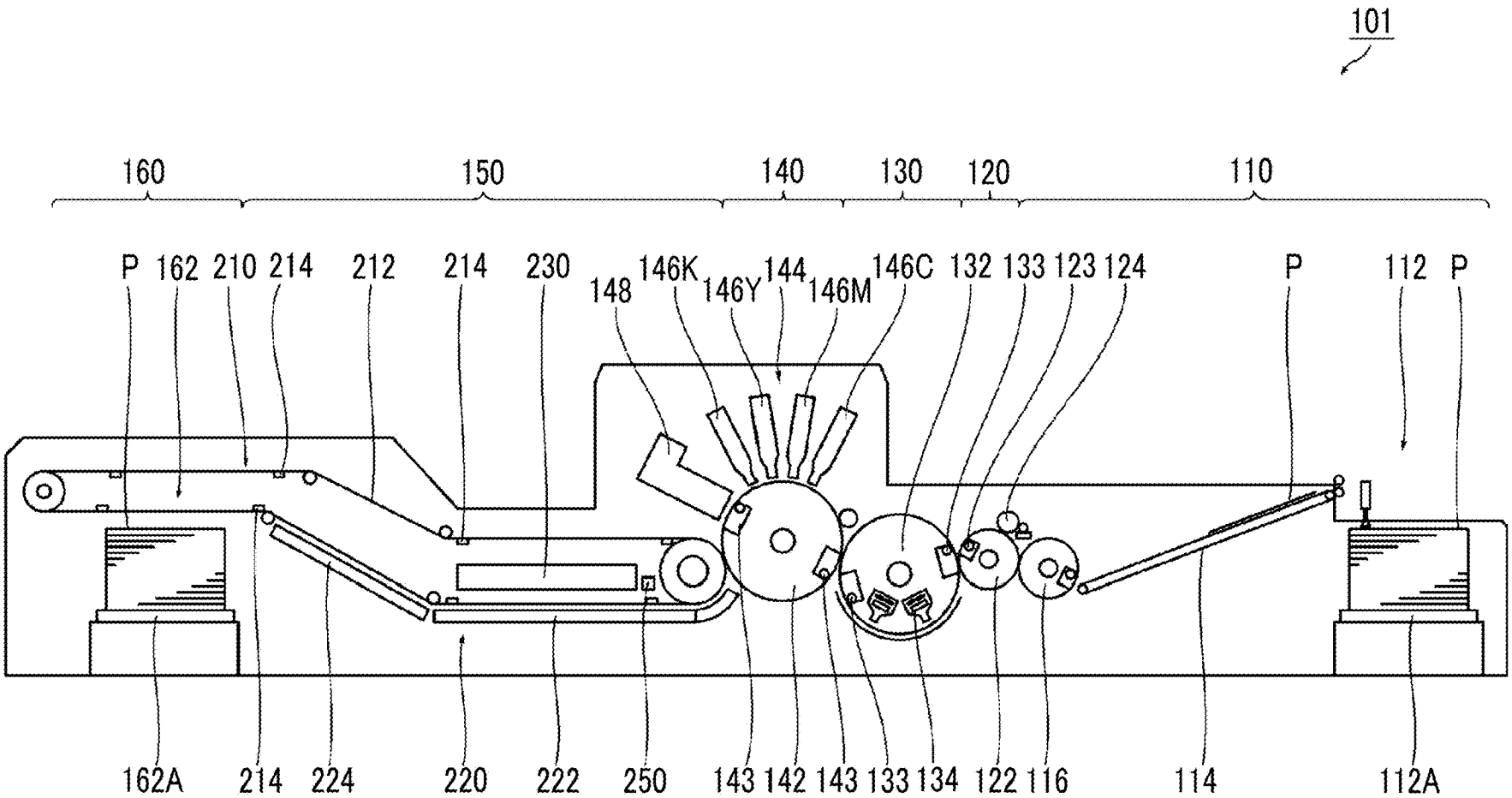
FIG. 14 is an overall configuration diagram illustrating a schematic configuration of an ink jet printer.

FIG. 14 is an overall configuration diagram illustrating a schematic configuration of the ink jet printer. The ink jet printer 101 illustrated in FIG. 14 is a sheet-fed type color ink jet printer that prints a color image on a sheet of paper P. The ink jet printer 101 corresponds to an example of the liquid jetting apparatus. Additionally, the paper P corresponds to an example of the medium.

The ink jet printer 101 includes a paper feed unit 110, a treatment liquid application unit 120, a treatment liquid drying unit 130, a drawing unit 140, an ink drying unit 150, and a stacking unit 160.

<Paper Feed Unit>

The paper feed unit 110 automatically feeds the paper P one by one. The paper feed unit 110 includes a paper feed device 112, a feeder board 114, and a paper feed drum 116. The paper feed device 112 takes out the paper P set in a paper feed tray 112A in a bundled state sheet by sheet in order from the top and feeds the paper to the feeder board 114. The feeder board 114 transfers the paper P, which has been received from the paper feed device 112, to the paper feed drum 116.

The paper feed drum 116 receives the paper P fed from the feeder board 114 and transfers the received paper P to the treatment liquid application unit 120.

<Treatment Liquid Application Unit>

The treatment liquid application unit 120 applies a pretreatment liquid to the paper P. The pretreatment liquid is a liquid including a function of aggregating, insolubilizing, or thickening a coloring material component in the ink. The treatment liquid application unit 120 includes a treatment liquid application drum 122 and a treatment liquid application device 124.

The treatment liquid application drum 122 receives the paper P from the paper feed drum 116, and transfers the received paper P to the treatment liquid drying unit 130. The treatment liquid application drum 122 includes a gripper 123 on a peripheral surface thereof. The treatment liquid application drum 122 rotates gripping a leading end of the paper P using the gripper 123, and winds the paper P around the peripheral surface to transport the paper P.

The treatment liquid application device 124 applies the pretreatment liquid to the paper P transported using the treatment liquid application drum 122. The pretreatment liquid is applied using a roller.

<Treatment Liquid Drying Unit>

The treatment liquid drying unit 130 performs drying treatment on dries the paper P to which the pretreatment liquid is applied. The treatment liquid drying unit 130 includes a treatment liquid drying drum 132 and a hot air blower 134. The treatment liquid drying drum 132 receives the paper P from the treatment liquid application drum 122 and transfers the received paper P to the drawing unit 140. The treatment liquid drying drum 132 includes a gripper 133 on a peripheral surface thereof. The treatment liquid drying drum 132 rotates gripping the leading end of the paper P using the gripper 133 and transports the paper P.

The hot air blower 134 is installed inside the treatment liquid drying drum 132. The hot air blower 134 blows hot air on the paper P transported using the treatment liquid drying drum 132 to dry the pretreatment liquid.

<Drawing Unit>

The drawing unit 140 includes a drawing drum 142, a head unit 144, and a scanner 148. The drawing drum 142 receives the paper P from the treatment liquid drying drum 132 and transfers the received paper P to the ink drying unit 150. The drawing drum 142 includes a gripper 143 on a peripheral surface thereof. The drawing drum 142 rotates gripping the leading end of the paper P with the gripper 143, and winds the paper P around the peripheral surface to transport the paper P. The drawing drum 142 corresponds to the transport unit 382 in FIG. 9.

The drawing drum 142 includes a suction mechanism (not illustrated), and suctions the paper P wound around the peripheral surface onto the peripheral surface to transport the paper P. Negative pressure is used for the suction. The drawing drum 142 has a large number of suction holes on the peripheral surface and suctions the paper P from the inside via the suction holes to suction the paper P onto the peripheral surface.

The head unit 144 includes a liquid jetting head 146C that jets ink droplets of cyan, a liquid jetting head 146M that jets ink droplets of magenta, a liquid jetting head 146Y that jets ink droplets of yellow, and a liquid jetting head 146K that jets ink droplets of black.

In addition, alphabets attached to the reference sign 146 representing the liquid jetting head represent colors of the ink jetted from the liquid jetting head. C represents cyan. M represents magenta and Y represents yellow. K represents black.

The liquid jetting head 146C, the liquid jetting head 146M, the liquid jetting head 146Y, and the liquid jetting head 146K illustrated in FIG. 14 correspond to the ink jet head 350 illustrated in FIG. 10. The liquid jetting head 146C, the liquid jetting head 146M, the liquid jetting head 146Y, and the liquid jetting head 146K are respectively arranged at regular intervals on a transport route of the paper P using the drawing drum 142.

In the present embodiment, a configuration in which four color inks of cyan, magenta, yellow, and black are used is exemplified. However, the combination of ink colors and the number of colors is not limited to the present embodiment, and a light ink, a dark ink, and a special color ink may be added as necessary. For example, a configuration is also possible in which liquid jetting heads jetting light color inks such as light cyan and light magenta are added, and the arrangement order of the liquid jetting heads of the respective colors is not particularly limited.

In a case where ink is jetted from the nozzles of the liquid jetting head 146C, the liquid jetting head 146M, the liquid jetting head 146Y, and the liquid jetting head 146K toward the paper P transported using the drawing drum 142, an image is recorded on the paper P.

The scanner 148 reads the image recorded on the paper P using the liquid jetting head 146C, the liquid jetting head 146M, the liquid jetting head 146Y, and the liquid jetting head 146K.

Read signals from the scanner 148 are used for the analysis of jetting abnormality and the like.

<Ink Drying Unit>

The ink drying unit 150 uses the drawing unit 140 to perform drying treatment on the paper P on which the image is recorded. The ink drying unit 150 includes a chain delivery 210, a paper guide 220, a hot air blowing unit 230, and a paper detection sensor 250.

The chain delivery 210 receives the paper P from the drawing drum 142 and transfers the received paper P to the stacking unit 160. The chain delivery 210 includes a pair of endless chains 212 that travel along a specified travel route.

The chain delivery 210 grips the leading end of the paper P using grippers 214 provided on the pair of chains 212, and transports the paper P along the specified transport route. A plurality of the grippers 214 are provided at regular intervals along a traveling direction of the chain 212.

The paper guide 220 is a member that guides the transport of the paper P using the chain delivery 210. The paper guide 220 is configured by a first paper guide 222 and a second paper guide 224.

The first paper guide 222 guides the paper P transported in a first transport section of the chain delivery 210. The second paper guide 224 guides the paper transported in a second transport section that is the subsequent stage of the first transport section.

The hot air blowing unit 230 blows hot air against the paper P transported using the chain delivery 210. The paper detection sensor 250 detects the presence or absence of the paper P. Examples of the paper detection sensor 250 include a reflective type optical sensor and a transmission type optical sensor.

<Stacking Unit>

The stacking unit 160 includes a stacking device 162 that receives the paper P transported from the ink drying unit 150 using the chain delivery 210 and stacks the paper P. The chain delivery 210 releases the paper P at a predetermined stacking position.

The stacking device 162 includes a stacking tray 162A. The stacking device 162 receives the paper P released from the chain delivery 210 and stacks the paper P in a bundle on the stacking tray 162A.

[Functional Block of Ink Jet Printer]

Figure 15:
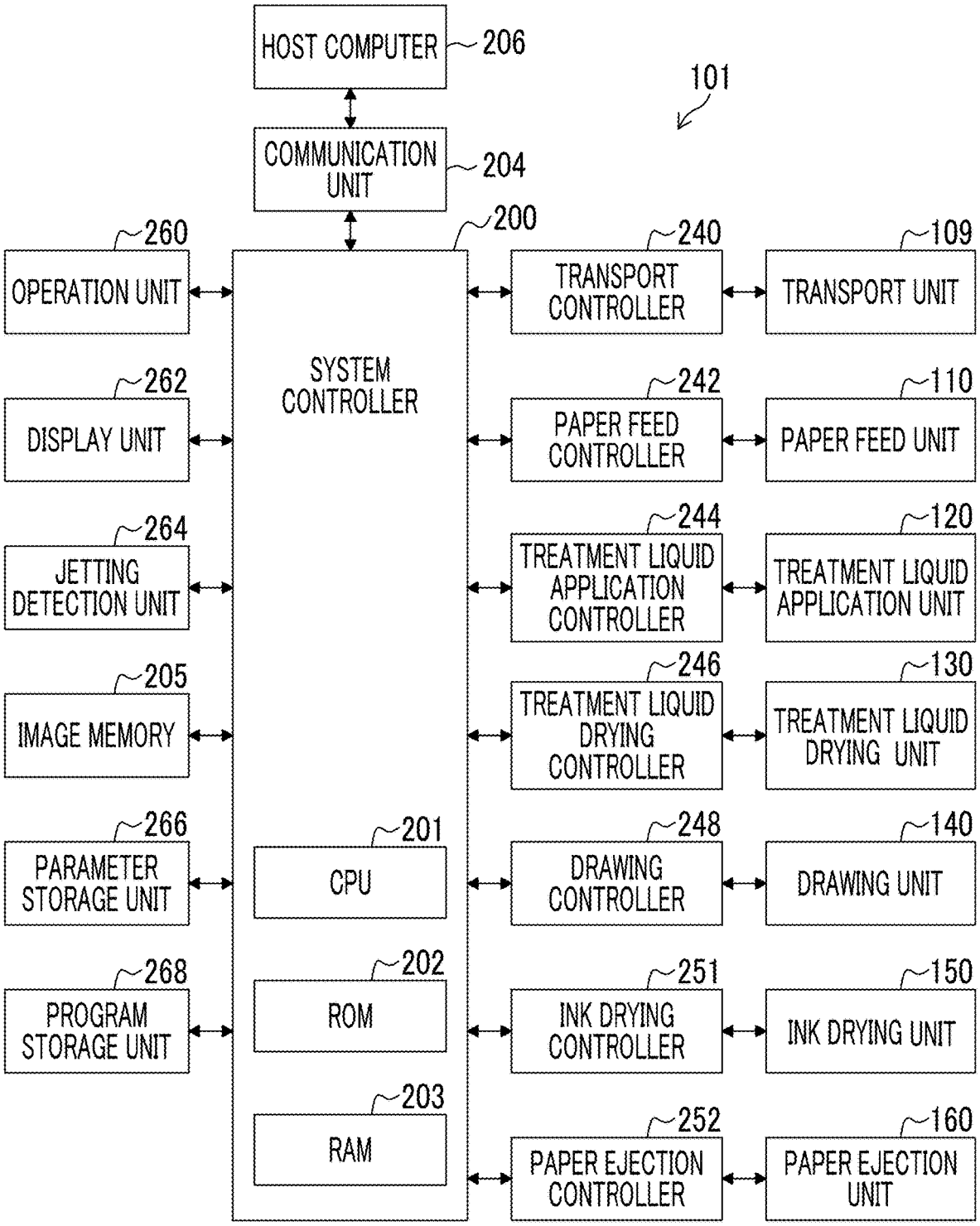
FIG. 15 is a functional block diagram of the ink jet printer illustrated in FIG. 14.

FIG. 15 is a functional block diagram of the ink jet printer illustrated in FIG. 14. The ink jet printer 101 includes a system controller 200. The system controller 200 includes a CPU 201, a ROM 202, and a RAM 203. The ROM 202 and the RAM 203 illustrated in FIG. 15 may be disposed outside the CPU.

The system controller 200 functions as an overall controller that comprehensively controls the respective units of the ink jet printer 101. Additionally, the system controller 200 also functions as a calculation unit that performs various calculation processing. The system controller 200 may execute a program to control the respective units of the ink jet printer 101.

Moreover, the system controller 200 functions as a memory controller that controls reading and writing of data in memories such as the ROM 202 and the RAM 203.

The ink jet printer 101 includes a communication unit 204, an image memory 205, a transport controller 240, a paper feed controller 242, a treatment liquid application controller 244, a treatment liquid drying controller 246, a drawing controller 248, an ink drying controller 251, and a paper ejection controller 252 is provided.

The communication unit 204 includes a communication interface (not illustrated). The communication unit 204 can send and receive data to and from a host computer 206 connected to the communication interface.

The image memory 205 functions as a temporary storage unit for various data including image data. Data is read from and written to the image memory 205 through the system controller 200. The image data incorporated loaded from the host computer 206 via the communication unit 204 is temporarily stored in the image memory 205.

The transport controller 240 controls the operation of the transport unit 109 for the paper P in the ink jet printer 101. The transport unit 109 illustrated in FIG. 15 includes the treatment liquid application drum 122, the treatment liquid drying drum 132, the drawing drum 142, and the chain delivery 210 illustrated in FIG. 1.

The paper feed controller 242 controls the operation of the paper feed unit 110 depending on a command from the system controller 200. The paper feed controller 242 controls a supply start operation for the paper P, a supply stop operation for the paper P, and the like.

The treatment liquid application controller 244 controls the operation of the treatment liquid application unit 120 depending on a command from the system controller 200. The treatment liquid application controller 244 controls the application amount, the application timing, and the like of the treatment liquid.

The treatment liquid drying controller 246 controls the operation of the treatment liquid drying unit 130 depending on a command from the system controller 200. The treatment liquid drying controller 246 controls the drying temperature, the flow rate of dry gas, the injection timing of the dry gas, and the like.

The drawing controller 248 controls the operation of the drawing unit 140 depending on a command from the system controller 200. The drawing controller 248 controls the ink jetting of the liquid jetting head 146C, the liquid jetting head 146M, the liquid jetting head 146Y, and the liquid jetting head 146K illustrated in FIG. 14.

The drawing controller 248 illustrated in FIG. 14 includes an image processing unit (not illustrated). The image processing unit forms dot data from input image data. The image processing unit includes a color separation processing unit, a color conversion processing unit, a correction processing unit, and a halftone processing unit, which are not illustrated.

The color separation processing unit performs the color separation processing on the input image data. For example, in a case where the input image data is represented by RGB, the input image data is separated into data for each of R, and B colors. Here, R represents red. G represents green. B represents blue. The color conversion processing unit converts the image data for each color separated into R, and B into C, M, Y, and K corresponding to ink colors.

The correction processing unit performs correction processing on the image data for each color converted into C, M, Y, and K. Examples of the correction processing include gamma-correction processing, density unevenness correction processing, and abnormal recording element correction processing.

The halftone processing unit converts, for example, image data represented by a multi-gradation number such as 0 to 255 into dot data represented by a binary value or a multiple value of a ternary value or more that is less than the number of gradations of the input image data.

A predetermined halftone processing rule is applied to the halftone processing using the halftone processing unit. Examples of the halftone processing rule include a dither method, an error diffusion method, and the like. The halftone processing rule may be changed depending on image recording conditions, the content of the image data, and the like.

The drawing controller 248 includes a waveform generation unit, a waveform storage unit, and a drive circuit. Constituent elements including the waveform generation unit, the waveform storage unit, and the drive circuit correspond to the ink jet head drive unit 10 illustrated in FIG. 9. In other words, the drawing controller 248 includes the ink jet head drive unit 10.

The waveform generation unit generates the waveform of the drive voltage. The waveform storage unit stores the waveform of the drive voltage. The drive circuit generates a drive voltage having a drive waveform according to the dot data. The drive circuit supplies the drive voltage to the liquid jetting head 146C, the liquid jetting head 146M, the liquid jetting head 146Y, and the liquid jetting head 146K illustrated in FIG. 14.

That is, the jetting timing of each pixel position and the ink jetting amount are determined on the basis of the dot data generated through the processing using the image processing unit, and the jetting timing of each pixel position, a drive voltage according to the ink jetting amount, and a control signal for determining the jetting timing of each pixel are generated on the basis of the dot data.

The drive voltage and the control signal are supplied to the liquid jetting head 146C, the liquid jetting head 146M, the liquid jetting head 146Y, and the liquid jetting head 146K. On the basis of the drive voltage and the control signal, dots are recorded on the paper P using the ink jetted from the liquid jetting head 146C, the liquid jetting head 146M, the liquid jetting head 146Y, and the liquid jetting head 146K.

The ink drying controller 251 controls the operation of the ink drying unit 150 depending on a command from the system controller 200. The ink drying controller 251 controls the temperature of the dry gas, the flow rate of the dry gas, the injection timing of the dry gas, and the like.

The paper ejection controller 252 controls the operation of the stacking unit 160 depending on a command from the system controller 200. In a case where the stacking tray 162A illustrated in FIG. 14 includes a lifting mechanism, the paper ejection controller 252 controls the operation of the lifting mechanism depending on the increase or decrease of the paper P.

The ink jet printer 101 illustrated in FIG. 15 includes an operation unit 260, a display unit 262, a jetting detection unit 264, a parameter storage unit 266, and a program storage unit 268.

The operation unit 260 includes operating members such as operation buttons, a keyboard, and a touch panel. The operation unit 260 may include a plurality of types of operating members. In addition, illustration of the operating member is omitted.

Information input via the operation unit 260 is sent to the system controller 200. The system controller 200 executes various processing depending on the information sent from the operation unit 260.

The display unit 262 includes a display device such as a liquid crystal panel and a display driver. In FIG. 15, the illustration of the display device and the display driver are omitted. The display unit 262 causes the display device to display various information such as various setting information and abnormality information of the apparatus depending on a command from the system controller 200.

The jetting detection unit 264 detects a jetting abnormality of the liquid jetting head 146C, the liquid jetting head 146M, the liquid jetting head 146Y, and the liquid jetting head 146K using the read signal transmitted from the scanner 148 illustrated in FIG. 14.

For example, a nozzle check pattern is formed on the paper P using the liquid jetting head 146C, the liquid jetting head 146M, the liquid jetting head 146Y, and the liquid jetting head 146K. The scanner 148 reads the nozzle check pattern and transmits the read signal to the jetting detection unit 264.

The scanner 148 corresponds to an example of a reading unit. The nozzle check pattern corresponds to an example of a jetting abnormality detection pattern. The read signal corresponds to an example of a reading result. The jetting detection unit 264 corresponds to an example of an abnormal nozzle detection unit.

The jetting detection unit 264 analyzes the read signal and detects an abnormal nozzle of the liquid jetting head 146C, the liquid jetting head 146M, the liquid jetting head 146Y, and the liquid jetting head 146K on the basis of the analysis result.

The parameter storage unit 266 stores various parameters used in the ink jet printer 101. Various parameters stored in the parameter storage unit 266 are read out via the system controller 200 and set in the respective units of the apparatus.

The program storage unit 268 stores programs used in the respective units of the ink jet printer 101. Various programs stored in the program storage unit 268 are read out via the system controller 200 and executed in the respective units of the apparatus.

In FIG. 15, the respective units are listed for the respective functions. The respective units illustrated in FIG. 15 can be appropriately integrated, separated, shared, or omitted. Hardware such as the respective controllers and the respective processing units illustrated in FIG. 15 may be configured by using one or more processors and one or more memories, similarly to the ink jet head drive unit 10 illustrated in FIG. 8. Additionally, two or more controllers, processing units and the like may be configured by using one processor or the like.

[Overflow Processing Applied to Ink Jet Printer]

Next, the overflow processing applied to the ink jet printer 101 described with reference to FIGS. 14 and 15 will be described.

[Overflow Processing Performed Between Paper Sheets]

Figure 16:
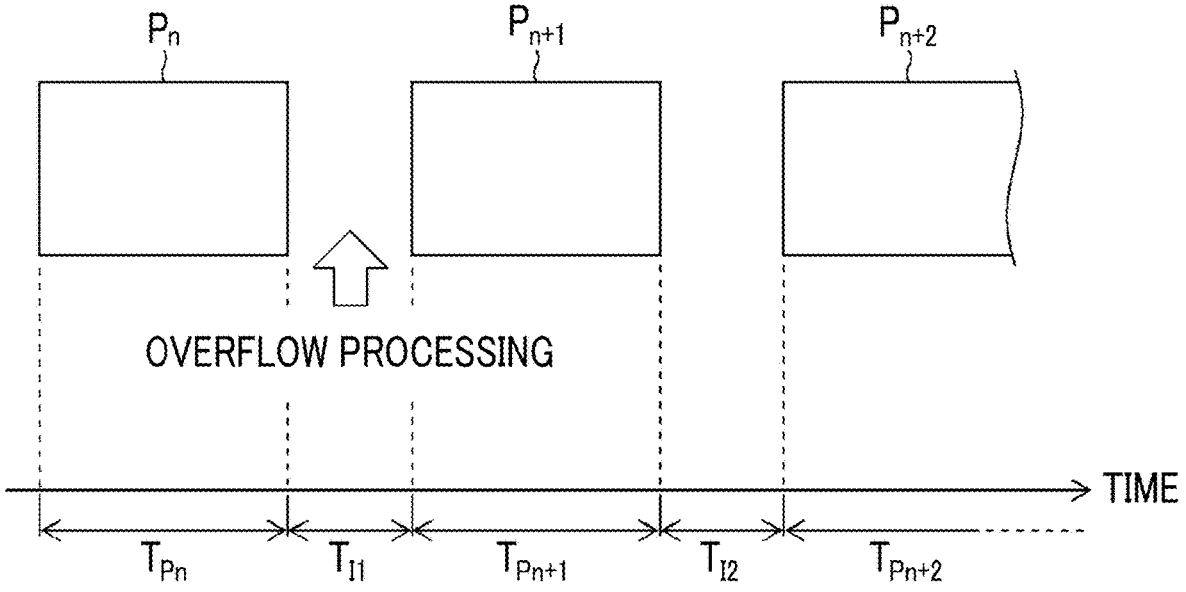
FIG. 16 is an explanatory view of the overflow processing performed between paper sheets.

FIG. 16 is an explanatory view of the overflow processing performed between paper sheets. FIG. 16 illustrates a case where the overflow processing is performed in an inter-paper-sheets period $T_{I1}$ between a printing period $T_{Pn}$ for which printing is performed on an nth paper $P_n$, and a printing period $T_{Pn+1}$ for which printing is performed on an (n+1)th paper $P_{n+1}$ in a case where the continuous printing is executed. The overflow processing may be performed in the inter-paper-sheets period $T_{I2}$ between the printing period $T_{Pn+1}$ and a printing period $T_{Pn+2}$.

In a case where the overflow processing is performed between the paper sheets, the transport of the paper P is continued without being stopped and decelerated. The overflow processing may be performed on all the liquid jetting heads 146 or may be selectively performed on some of the liquid jetting heads 146. In addition, the liquid jetting head 146 represents a general term or any one of the liquid jetting head 146C, the liquid jetting head 146M, the liquid jetting head 146Y, and the liquid jetting head 146K illustrated in FIG. 14.

The paper P on which the printing is executed corresponds to an example of a resultant product. The printing corresponds to an example of generation of the resultant product. The printing data corresponds to an example of jetting data representing the resultant product. The inter-paper-sheets period $T_I$ corresponds to an example between the generation of the resultant product and the generation of the next resultant product.

[Operational Effects]

According to the overflow processing performed between the paper sheets, it is possible to perform the overflow processing on the liquid jetting head 146 without stopping and decelerating the transport of the paper P. Accordingly, the downtime can be reduced.

[Overflow Processing Performed for Each Region]

Figure 17:
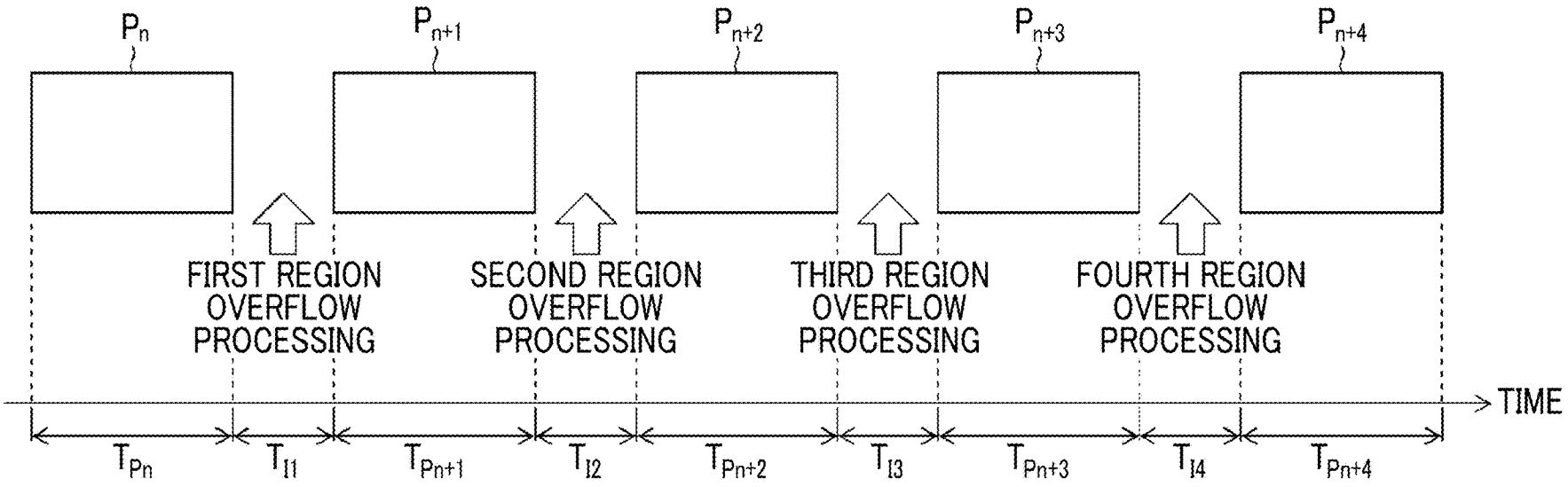
FIG. 17 is an explanatory view of the overflow processing performed for each region.

FIG. 17 is an explanatory view of the overflow processing performed for each region. In the overflow processing illustrated in the present example, the nozzle 20 provided in the liquid jetting head 146 is divided into four regions, and the overflow processing is performed for each region.

As illustrated in FIG. 17, the overflow processing for a first region is performed in the inter-paper-sheets period $T_{I1}$ between the printing period $T_{Pn}$ to the nth paper $P_n$ and the printing period $T_{Pn+1}$ to the n+1th paper $P_{n+1}$. Similarly, the overflow processing for a second region is performed in an inter-paper-sheets period $T_{I2}$ between the printing period $T_{Pn+1}$ to the n+1th paper $P_{n+1}$ and a printing period $T_{Pn+2}$ to a n+2th paper $P_{n+2}$.

Moreover, the overflow processing for a third region is performed in an inter-paper-sheets period $T_{I3}$ between the printing period $T_{Pn+2}$ to an n+2th paper $P_{n+2}$, and a printing period $T_{Pn+3}$ to an n+3th paper $P_{n+3}$. The overflow processing for a fourth region is performed in an inter-paper-sheets period $T_{I4}$ between the printing period $T_{Pn+3}$ to the n+3th paper$_{Pn+3}$ and a printing period $T_{Pn+4}$ to an n+4th paper$_{Pn+4}$.

Figure 18:
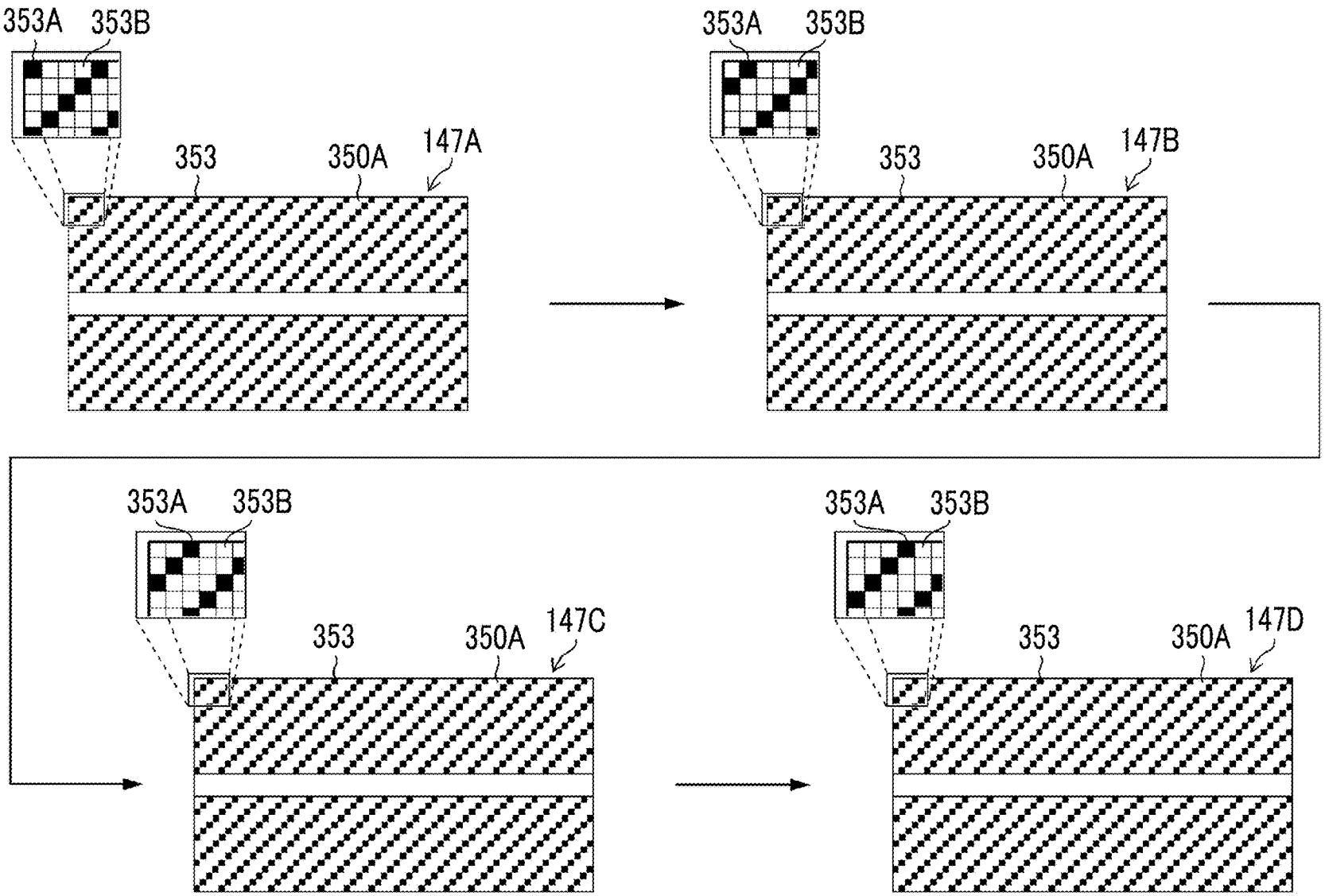
FIG. 18 is an explanatory view of a region.

FIG. 18 is an explanatory view of regions. In FIG. 18, a part of the nozzle surface 350A is illustrated in an enlarged manner. Squares in the partially enlarged view of the nozzle surface 350A represent the nozzle openings 353. Black nozzle openings 353A are targets of the overflow processing. White nozzle openings 353B are non-targets of the overflow processing. In addition, the nozzle openings may be replaced as nozzles.

Reference sign 147A illustrated in FIG. 18 indicates the first region. Reference sign 147B indicates the second region. Reference sign 147C indicates the third region.

Reference sign 147D indicates the fourth region. Arrow lines illustrated in FIG. 18 indicate the flow of the overflow processing.

The respective regions illustrated in FIG. 18 can be realized by performing mask processing on non-target nozzles of the overflow processing. That is, in a case where the overflow processing is performed for each region, a mask corresponding to each region is prepared and the mask is switched depending on a region where the overflow processing is performed.

As the mask applied to the overflow processing, a mask used for other maintenance processing such as dummy jet may be applied. A division example of the plurality of regions illustrated in FIG. 18 is an example, and the nozzles in each region, the number of divisions, and the like may be appropriately changed.

[Operational Effects]

According to the overflow processing performed by dividing all the nozzles into the plurality of regions and the overflow processing performed for each region, it is possible to reduce the variation in the overflow of each nozzle.

[Overflow Processing Performed for Each Color]

As a side effect of the overflow processing, the jetting state of a normal nozzle may temporarily deteriorate. In a case where a nozzle whose jetting state has deteriorated is generated, the nozzle whose jetting state has deteriorated is detected during a printing job without changing transport control such as stopping the transport of the paper P, and processing such as mask correction is performed. In addition, the mask correction corresponds to an example of non-jetting processing.

Figure 19:
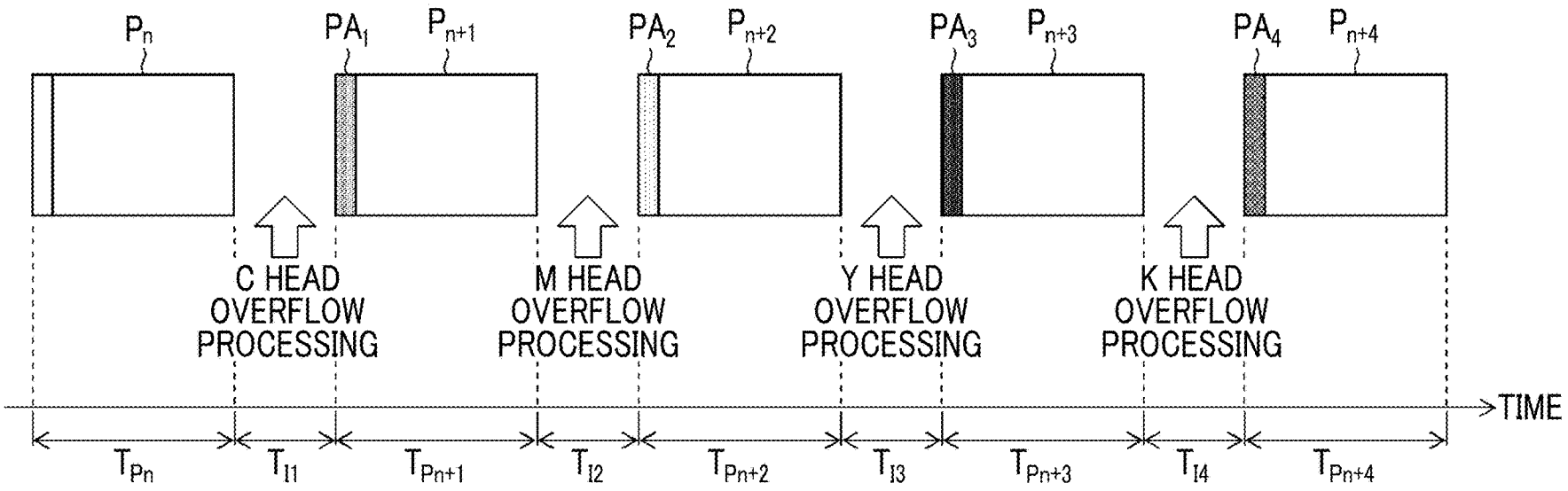
FIG. 19 is an explanatory view of the overflow processing performed for each color.

FIG. 19 is an explanatory view of the overflow processing performed for each color. A C head illustrated in FIG. 19 represents the liquid jetting head 146C. Similarly, a M head represents the liquid jetting head 146M. A Y head represents the liquid jetting head 146Y. A K head represents the liquid jetting head 146K.

In a case where it is difficult to print the nozzle detection patterns of all the liquid jetting heads 146 in blank regions of one paper P such as a case where the blank region of the paper P is small, the nozzle detection pattern of one liquid jetting head 146 is formed in the blank regions of one paper P.

The overflow processing for the liquid jetting head 146C is performed in the inter-paper-sheets period $T_{I1}$ between the printing period $T_{Pn}$ to the nth paper $P_n$ and the printing period $T_{Pn+1}$ to the (n+1)th paper $P_{n+1}$ illustrated in FIG. 19.

The nozzle detection pattern of the liquid jetting head 146C is formed in a blank region $PA_1$ of the paper $P_{n+1}$ immediately after the overflow processing for the liquid jetting head 146C is performed, and an abnormal nozzle of the liquid jetting head 146C is detected.

Similarly, the overflow processing for the liquid jetting head 146M is performed in the inter-paper-sheets period $T_{I2}$ between the printing period $T_{Pn+1}$ to the n+1th paper $P_{n+1}$ and the printing period $T_{Pn+2}$ to the n+2th paper $P_{n+2}$.

The nozzle detection pattern of the liquid jetting head 146M is formed in a blank region $PA_2$ of the paper $P_{n+2}$ immediately after the overflow processing for the liquid jetting head 146M is performed, and an abnormal nozzle of the liquid jetting head 146M is detected.

Moreover, the overflow processing for the liquid jetting head 146Y is performed in the inter-paper-sheets period $T_{I3}$ between the printing period $T_{Pn+2}$ to the n+2th paper $P_{n+2}$, and the printing period $T_{Pn+3}$ to the n+3th paper $P_{n+3}$.

The nozzle detection pattern of the liquid jetting head 146Y is formed in a blank region $PA_3$ of the paper $P_{n+3}$ immediately after the overflow processing for the liquid jetting head 146Y is performed, and an abnormal nozzle of the liquid jetting head 146Y is detected.

The overflow processing for the liquid jetting head 146K is performed in the inter-paper-sheets period $T_{I4}$ between the printing period $T_{Pn+3}$ to the n+3th paper $P_{n+3}$, and the printing period $T_{Pn+4}$ to the n+4th paper $P_{n+4}$.

The nozzle detection pattern of the liquid jetting head 146K is formed in a blank region PA4 of the paper $P_{n+4}$ immediately after the overflow processing for the liquid jetting head 146K is performed, and an abnormal nozzle of the liquid jetting head 146K is detected.

In the present embodiment, a case has been described in which the overflow processing is performed with each of all the liquid jetting heads 146 provided in the ink jet printer 101 one by one in the arrangement order as a target. Meanwhile, the overflow processing of the liquid jetting head 146, which has a low frequency of use, such as the liquid jetting head 146Y, may be omitted.

Additionally, in a case where the nozzle detection patterns of the two liquid jetting heads 146 or the three liquid jetting heads 146 are formed in the blank regions of the paper P, overflow processing may be performed the two liquid jetting heads 146 or the three liquid jetting heads 146 may be used in the same inter-paper-sheets period $T_I$. Moreover, the order of the overflow processing and the formation of the nozzle detection patterns can be appropriately determined.

The cyan ink, the magenta ink, the yellow ink, and the black ink correspond to examples of different types of liquid, respectively. The liquid jetting head 146C, the liquid jetting head 146M, the liquid jetting head 146Y, and the liquid jetting head 146K correspond to examples of a plurality of liquid jetting heads that jet the different types of liquid, respectively.

A period during which the nozzle detection patterns of the liquid jetting head 146C, the liquid jetting head 146M, the liquid jetting head 146Y, and the liquid jetting head 146K are formed corresponds to a period after the overflow drive voltage is supplied to the jetting heads and before the next resultant product is generated.

[Operational Effects]

According to the overflow processing performed for each color, it is not necessary to form the nozzle detection patterns of all the liquid jetting heads 146 using the printing region of one sheet of paper P, and the paper P used for forming the nozzle detection patterns does not become a waste paper. Accordingly, the wasted paper can be reduced. In addition, the printing region of the paper P is a region where targeted printing based on the printing data is performed.

In a case where the liquid jetting head 146 including the plurality of head modules 352 can supply the overflow drive voltage to each head module 352, the overflow processing may be performed for each head module 352.

[Procedure for Overflow Processing]

Figure 20:
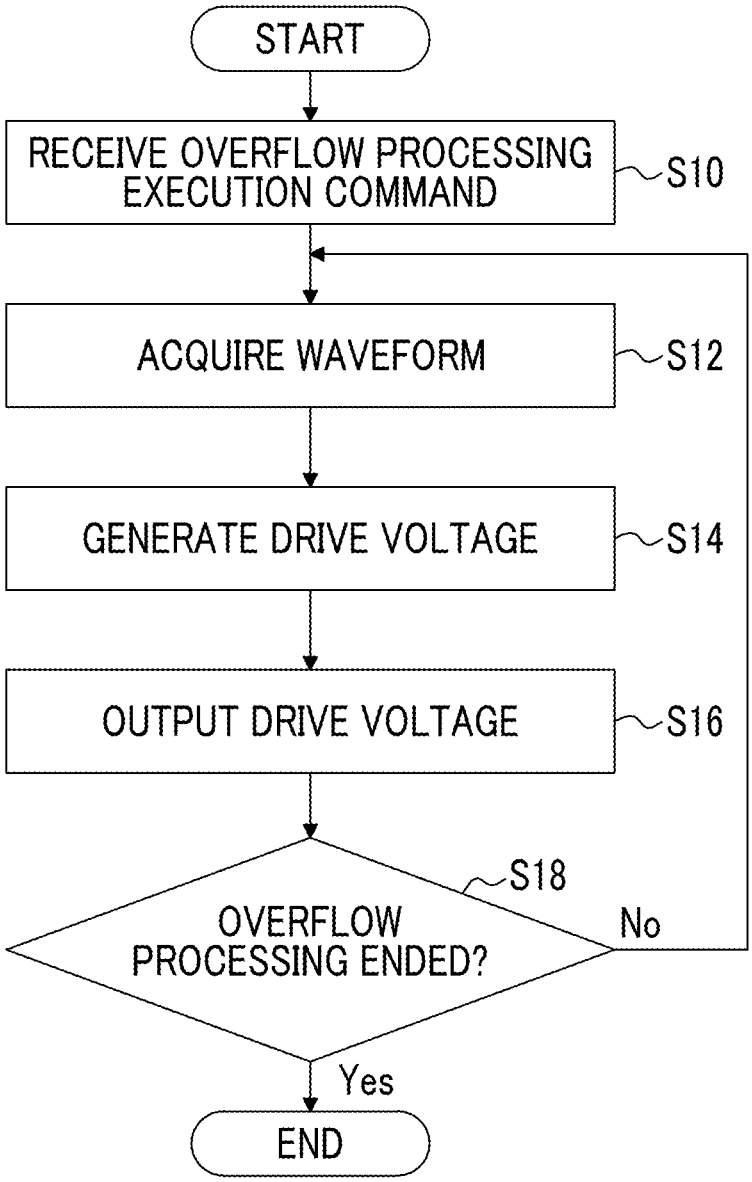
FIG. 20 is a flowchart illustrating a procedure flow of the overflow processing.

FIG. 20 is a flowchart illustrating a procedure flow of an ink jet head drive method in a case where the overflow processing is performed. The ink jet head drive method corresponds to a jetting head drive method.

In a command signal reception step S10, the ink jet head drive unit 10 transmits an overflow processing execution command transmitted from the high-level data control device 380 illustrated in FIG. 9. After the command signal reception step S10, the process proceeds to a waveform acquisition step S12.

In the waveform acquisition step S12, the drive voltage control circuit 368 acquires data of an overflow waveform from the waveform data memory 366. After the waveform acquisition step S12, the process proceeds to a drive voltage generation step S14.

The waveform acquisition step S12 corresponds to an example of a drive waveform acquisition step.

In the drive voltage generation step S14, the drive voltage control circuit 368 and the digital-to-analog converter 379 generate the overflow drive voltage 1330 on the basis of the overflow waveform. In the drive voltage generation step S14, the image data transmission control circuit 364 reads out image data for overflow processing from the image data memory 362. The image data for overflow processing may be transmitted from the high-level data control device 380 or may be stored in advance and read out.

In the drive voltage generation step S14, the drive voltage control circuit 368 generates an analog overflow waveform on the basis of digital overflow waveform data read out from the waveform data memory 366. The digital-to-analog converter 379 and the power amplification circuit 377 generate an overflow drive voltage on the basis of the overflow waveform. Additionally, the image data transmission control circuit 364 generates nozzle control data for overflow processing on the basis of the image data for overflow processing. After the drive voltage generation step S14, the process proceeds to a drive voltage output step S16.

In the drive voltage output step S16, the ink jet head drive unit 10 supplies an overflow drive voltage, nozzle control data for overflow processing, and a data latch signal to the ink jet head 350. After the drive voltage output step S16, the process proceeds to an overflow processing end determination step S18. The drive voltage output step S16 corresponds to an example of a drive voltage supply step.

In the overflow processing end determination step S18, the ink jet head drive unit 10 determines whether the overflow processing is ended or the overflow processing is continued. In the processing end determination step S18, a No determination is made in a case where the overflow processing is continued.

In the case of the No determination, the process proceeds to the waveform acquisition step S12, and the respective steps from the waveform acquisition step S12 to the processing end determination step S18 are repeatedly executed until a Yes determination is made in the processing end determination step S18.

On the other hand, in the processing end determination step S18, a Yes determination is made in a case where the overflow processing is ended. In the case of the Yes determination, the ink jet head drive unit 10 ends the overflow processing. Examples of the case where the overflow processing is ended include a case where a specified overflow processing period has elapsed, a case where a forced end processing command is acquired during the overflow processing, and the like.

The ink jet head drive method illustrated in FIG. 20 may include a drive waveform generation step of generating the drive waveform. The drive waveform generation step may include a parameter setting step of setting the parameters of the drive waveform. The drive waveform generation step may include an overflow period setting step of setting the overflow period. In the overflow period setting step, the number of overflow pulses may be set.

The ink jet head drive method may include an input step of inputting the parameters of the drive waveform. The ink jet head drive method may include a display step of displaying the parameters of the drive waveform, the overflow period, and the statically determinate period.

In a case where the overflow processing is performed in the inter-paper-sheets period $T_I$ illustrated in FIG. 16, the drive voltage control circuit 368 acquires the overflow waveform including a pulse number based on the inter-paper-sheets period $T_I$ in the waveform acquisition step S12.

In a case where the overflow processing is performed for each region illustrated in FIG. 17, the image data transmission control circuit 364 acquires image data corresponding to a mask 147 for each region illustrated in FIG. 18 in the waveform acquisition step S12.

[Example of Application to Programs]

The above-described ink jet head drive unit and method can be realized by using a computer to execute a program that realizes functions corresponding to the respective units in the ink jet head drive unit and functions corresponding to the respective steps in the ink jet head drive method.

For example, an ink jet head drive program may be configured that causes the computer to realize a drive waveform acquisition function of acquiring the drive waveform, a drive voltage generation function of generating the drive voltage on the basis of the drive waveform, and a drive voltage supply function of supplying the drive voltage to the ink jet head. The ink jet head drive program corresponds to an example of a jetting head drive program.

It is possible to store a program for causing the computer to realize an ink jet head drive function in a case where the above-described overflow processing is performed, in a computer-readable information storage medium that is a non-temporary information storage medium that is a tangible object, and provide the program through the information storage medium.

Additionally, instead of the aspect in which the program is stored and provided in the non-temporary information storage medium, an aspect in which program signals are provided via the network is also possible.

Explanation of Terms

[Ink]

The ink represents a liquid that forms an image on a medium. The state of the ink before supply to the jetting head and the state of the ink held in the jetting head before jetting may be solid. The ink may include ink for graphic applications containing a color material and the like, and a functional liquid for industrial applications use containing resin particles, metal particles, and the like. The ink corresponds to an example of the liquid.

[Medium]

The medium represents media such as paper, fibers, leather, metals, resins, glass, wood, and ceramics on which image forming liquids can be made to adhere. In the present specification, the medium, the paper, recording paper, printing paper, recording medium, and printing medium can be replaced with each other.

[Image Forming]

The image forming, the printing, the image recording, and the recording means causing the liquids to adhere to the medium to form shapes such as texts, figures, and patterns. Whether the formed shape is in black and white or color does not matter. In the present specification, the image forming, the printing, the printing, the image recording, and the recording can be replaced with each other.

[Parallel and Orthogonal]

The parallel may include substantially parallel in which the same operational effects as the parallel can be obtained in a case where two directions intersect each other. The orthogonal may include substantially orthogonal in which the same operational effects as the case of intersecting at 90 degrees in a case where two directions intersect each other at an angle exceeding 90 degrees or an angle of less than 90 degrees.

[Same]

Although the same is strictly different, the same may include substantially the same in which the same operational effects effect as the same can be obtained.

[Combination of Embodiments and Modification Examples]

The constituent elements described in the above-described embodiment and the constituent elements described in the examples of application and the like can be used in an appropriate combination, and some of the constituent elements can be replaced.

In the embodiment of the present invention described above, it is possible to appropriately change, add, or delete the configuration requirements without departing from the spirit of the present invention. The present invention is not limited to the embodiment described above, and many modifications can be made by a person having ordinary skill in the art within the technical idea of the present invention.

EXPLANATION OF REFERENCES

10: Ink jet head drive unit
20: nozzle
22: ejector
24: individual supply passage
26: supply-side common branch flow channel
30: pressure chamber
31: piezoelectric element
32: vibration plate
33: individual electrode
34: piezoelectric body
35: cover plate
36: movable space
40: controller
42: memory
44: storage device
46: network controller
48: power supply
50: network
52: bus
101: ink jet printer
109: transport unit
110: paper feed unit
112: paper feed device
112*a*: paper feed tray
114: feeder board
116: paper feed drum
120: treatment liquid application unit
122: treatment liquid application drum
130: treatment liquid drying unit
132: treatment liquid drying drum
133: gripper
134: hot air blower
140: drawing unit
142: drawing drum
143: gripper
144: head unit
146: liquid jetting head
146C: liquid jetting head
146M: liquid jetting head
146Y: liquid jetting head
146K: liquid jetting head
147: mask
147A: first region
147B: second region
147C: third region
147C: fourth region
148: scanner
150: ink drying unit
160: stacking unit
162: stacking device
162A: stacking tray
200: system controller
201: CPU
202: ROM
203: RAM
204: communication unit
205: image memory
206: host computer
210: chain delivery
212: chain
214: gripper
220: paper guide
222: first paper guide
224: second paper guide
230: hot air blowing unit
240: transport controller
242: paper feed controller
244: treatment liquid application controller
246: treatment liquid drying controller
248: drawing controller
250: paper detection sensor
251: ink drying controller
252: paper ejection controller
260: operation unit
262: display unit
264: jetting detection unit
266: parameter storage unit
268: program storage unit
309: electrical connection cable
310: support frame
311: dummy plate
311A: surface
312: nozzle arrangement unit
350: ink jet head
350A: nozzle surface
352: head module
352A: head module
352B: head module
353: nozzle opening
353A: nozzle opening
353B: nozzle opening
362: image data memory
364: image data transmission control circuit
365: jetting timing controller
366: waveform data memory
368: drive voltage control circuit
379: digital-to-analog converter
379A: digital-to-analog converter
379B: digital-to-analog converter
380: high-level data control device
382: transport unit
390: electric circuit board
392: image data transmission line, data bus
392A: image data transmission line
392B: image data transmission line
394: connector
394A: connector
394B: connector
396: signal line

396A: signal line
396B: signal line
1000: ink jet head
1002: nozzle
1004: nozzle surface
1006: ink mist
1008: ink
1010: ink liquid surface
1012: ink
1014: liquid droplet
1016: region
1018: liquid droplet
1100: overflow pulse waveform
1100A: rising waveform element
1100B: fixed voltage waveform element
1100C: falling waveform element
1200: jetting pulse
1200A: rising waveform element
1200B: fixed voltage waveform element
1200C: falling waveform element
1202: first jetting pulse
1204: second jetting pulse
1206: third jetting pulse
1208: fourth jetting pulse
1210: fifth jetting pulse
1300: overflow drive voltage
1310: jetting drive voltage
1330: meniscus fluctuation drive voltage
1332: fluctuation pulse
1332A: fourth waveform element
1332B: fifth waveform element
1332C: sixth waveform element
S10 to S18: respective steps of ink jet head drive method

What is claimed is:

1. A jetting head drive unit including a plurality of nozzles and a plurality of piezoelectric elements corresponding to the plurality of nozzles, the jetting head drive unit comprising:

a drive waveform acquisition unit that acquires a drive waveform;

a drive voltage generation unit that generates a drive voltage to be supplied to the piezoelectric elements using the drive waveform; and a drive voltage supply unit that supplies the drive voltage to the piezoelectric elements, wherein the drive waveform acquisition unit acquires an overflow waveform used to generate an overflow drive voltage when a liquid is caused to overflow from the nozzle to a nozzle surface without jetting the liquid from the nozzle, wherein the drive voltage generation unit uses the overflow waveform to generate the overflow drive voltage including one or more overflow pulses corresponding to a period of 0.2 seconds or more and 90 seconds or less, and wherein the overflow pulses are configured by the drive voltage generation unit to be proportional to a jetting pulse so as to have a pulse width of 1.2 times or more and 1.8 times or less, an amplitude of 0.3 times or more and 0.8 times or less, and at least one of a rising period or a falling period of 0.3 times or less, with respect to the jetting pulse included in a jetting drive voltage when the liquid is jetted from the nozzles.

2. The jetting head drive unit according to claim 1, wherein the drive voltage supply unit supplies the drive voltage to the jetting head after a period of 0.5 seconds or more and 120 seconds or less has elapsed from a termination timing of the overflow drive voltage.

3. The jetting head drive unit according to claim 2, wherein the pulse width of the overflow pulse is three-fourths of a natural period of a surface of the liquid.

4. The jetting head drive unit according to claim 3, wherein the jetting head is divided into a plurality of regions including one or more nozzles, and wherein the drive voltage supply unit supplies the overflow drive voltage to the jetting head for each of the regions.

5. The jetting head drive unit according to claim 3, wherein the overflow waveform includes a plurality of the overflow pulses.

6. The jetting head drive unit according to claim 2, wherein the jetting head is divided into a plurality of regions including one or more nozzles, and wherein the drive voltage supply unit supplies the overflow drive voltage to the jetting head for each of the regions.

7. The jetting head drive unit according to claim 2, wherein the overflow waveform includes a plurality of the overflow pulses.

8. The jetting head drive unit according to claim 1, wherein the pulse width of the overflow pulse is three-fourths of a natural period of a surface of the liquid.

9. The jetting head drive unit according to claim 8, wherein the jetting head is divided into a plurality of regions including one or more nozzles, and wherein the drive voltage supply unit supplies the overflow drive voltage to the jetting head for each of the regions.

10. The jetting head drive unit according to claim 8, wherein the overflow waveform includes a plurality of the overflow pulses.

11. The jetting head drive unit according to claim 1, wherein the jetting head is divided into a plurality of regions including one or more nozzles, and wherein the drive voltage supply unit supplies the overflow drive voltage to the jetting head for each of the regions.

12. The jetting head drive unit according to claim 1, wherein the overflow waveform includes a plurality of the overflow pulses.

13. A jetting head unit comprising:

a jetting head including a plurality of nozzles and a plurality of piezoelectric elements corresponding to the plurality of nozzles; and a drive unit that drives the jetting head, wherein the drive unit includes:

a drive waveform acquisition unit that acquires a drive waveform;

a drive voltage generation unit that generates a drive voltage to be supplied to the piezoelectric elements using the drive waveform; and a drive voltage supply unit that supplies the drive voltage to the piezoelectric elements, wherein the drive waveform acquisition unit acquires an overflow waveform used to generate an overflow drive voltage when a liquid is caused to overflow from the nozzle to a nozzle surface without jetting the liquid from the nozzle, wherein the drive voltage generation unit uses the overflow waveform to generate the overflow drive voltage including one or more overflow pulses corresponding to a period of 0.2 seconds or more and 90 seconds or less, and wherein the overflow pulses are configured by the drive voltage generation unit to be proportional to a jetting pulse so as to have a pulse width of 1.2 times or more and 1.8 times or less, an amplitude of 0.3 times or more and 0.8 times or less, and at least one of a rising period or a falling period of 0.3 times or less, with respect to the jetting pulse included in a jetting drive voltage when the liquid is jetted from the nozzles.

14. A liquid jetting apparatus comprising:

a jetting head including a plurality of nozzles and a plurality of piezoelectric elements corresponding to the plurality of nozzles; and a drive unit that drives the jetting head, wherein the drive unit includes:

a drive waveform acquisition unit that acquires a drive waveform;

a drive voltage generation unit that generates a drive voltage to be supplied to the piezoelectric elements using the drive waveform; and a drive voltage supply unit that supplies the drive voltage to the piezoelectric elements, wherein the drive waveform acquisition unit acquires an overflow waveform used to generate an overflow drive voltage when a liquid is caused to overflow from the nozzle to a nozzle surface without jetting the liquid from the nozzle, wherein the drive voltage generation unit uses the overflow waveform to generate the overflow drive voltage including one or more overflow pulses corresponding to a period of 0.2 seconds or more and 90 seconds or less, and wherein the overflow pulses are configured by the drive voltage generation unit to be proportional to a jetting pulse so as to have a pulse width of 1.2 times or more and 1.8 times or less and an amplitude of 0.3 times or more and 0.8 times or less, and at least one of a rising period or a falling period of 0.3 times or less, with respect to the jetting pulse included in a jetting drive voltage when the liquid is jetted from the nozzles.

15. The liquid jetting apparatus according to claim 14, wherein, when the liquid is jetted from the jetting head to continuously generate a plurality of resultant products, the drive voltage supply unit supplies the overflow drive voltage to the jetting head between generation of the resultant product and generation of the next resultant product that are performed using a jetting drive voltage based on jetting data representing the resultant products.

16. The liquid jetting apparatus according to claim 14, further comprising:

a reading unit that reads a jetting abnormality detection pattern; and an abnormal nozzle detection unit that detects an abnormal nozzle from a reading result of the jetting abnormality detection pattern obtained using the reading unit, wherein the drive voltage supply unit supplies the overflow drive voltage to the jetting head, and then supplies a detected drive voltage corresponding to the jetting abnormality detection pattern to the jetting head to form the jetting abnormality detection pattern before the next resultant product is generated, and wherein the abnormal nozzle detection unit detects an abnormal nozzle in the jetting head after the overflow drive voltage is supplied.

17. The liquid jetting apparatus according to claim 16, wherein a plurality of the jetting heads that jets different types of liquid is provided, and wherein the drive voltage supply unit supplies the overflow drive voltage and then supplies the detected drive voltage to the jetting heads to which the overflow drive voltage is supplied, to form the jetting abnormality detection pattern.

18. A method for driving a jetting head including a plurality of nozzles and a plurality of piezoelectric elements corresponding to the plurality of nozzles, the jetting head drive method comprising:

a drive waveform acquisition step of acquiring a drive waveform;

a drive voltage generation step of generating a drive voltage to be supplied to the piezoelectric elements using the drive waveform; and a drive voltage supply step of supplying the drive voltage to the piezoelectric elements, wherein the drive waveform acquisition step acquires an overflow waveform used to generate an overflow drive voltage when a liquid is caused to overflow from the nozzle to a nozzle surface without jetting the liquid from the nozzle, wherein the drive voltage generation step uses the overflow waveform to generate the overflow drive voltage including one or more overflow pulses corresponding to a period of 0.2 seconds or more and 90 seconds or less, and wherein the overflow pulses are configured by the drive voltage generation unit to be proportional to a jetting pulse so as to have a pulse width of 1.2 times or more and 1.8 times or less, an amplitude of 0.3 times or more and 0.8 times or less, and at least one of a rising period or a falling period of 0.3 times or less, with respect to jetting pulse included in a jetting drive voltage when the liquid is jetted from the nozzles.

19. A non-transitory computer readable recording medium storing a program to be applied to driving of a jetting head including a plurality of nozzles and a plurality of piezoelectric elements corresponding to the plurality of nozzles, the program causing a computer to realize a drive waveform acquisition function of acquiring a drive waveform;

a drive voltage generation function of generating a drive voltage to be supplied to the piezoelectric elements using the drive waveform;

and a drive voltage supply function of supplying the drive voltage to the piezoelectric elements, wherein the drive waveform acquisition function acquires an overflow waveform used to generate an overflow drive voltage when a liquid is caused to overflow from the nozzle to a nozzle surface without jetting the liquid from the nozzle, wherein the drive voltage generation function uses the overflow waveform to generate the overflow drive voltage including one or more overflow pulses corresponding to a period of 0.2 seconds or more and 90 seconds or less, and wherein the overflow pulses are configured by the drive voltage generation unit to be proportional to a jetting pulse so as to have a pulse width of 1.2 times or more and 1.8 times or less, an amplitude of 0.3 times or more and 0.8 times or less, and at least one of a rising period or a falling period of 0.3 times or less, with respect to the jetting pulse included in a jetting drive voltage when the liquid is jetted from the nozzles.

20. A jetting head drive unit including a plurality of nozzles and a plurality of piezoelectric elements corresponding to the plurality of nozzles, the jetting head drive unit comprising one or more processors configured to function as:

a drive waveform acquisition unit that acquires a drive waveform;

a drive voltage generation unit that generates a drive voltage to be supplied to the piezoelectric elements using the drive waveform; and a drive voltage supply unit that supplies the drive voltage to the piezoelectric elements, wherein the drive waveform acquisition unit acquires an overflow waveform used to generate an overflow drive voltage when a liquid is caused to overflow from the nozzle to a nozzle surface without jetting the liquid from the nozzle, wherein the drive voltage generation unit uses the overflow waveform to generate the overflow drive voltage including one or more overflow pulses corresponding to a period of 0.2 seconds or more and 90 seconds or less, and wherein the overflow pulses are configured by the drive voltage generation unit to be proportional to a jetting pulse so as to have a pulse width of 1.2 times or more and 1.8 times or less, an amplitude of 0.3 times or more and 0.8 times or less, and at least one of a rising period or a falling period of 0.3 times or less, with respect to the jetting pulse included in a jetting drive voltage when the liquid is jetted from the nozzles.

* * * * *